US005926199A

United States Patent [19]

Matoba et al.

[11] Patent Number: 5,926,199

[45] Date of Patent: Jul. 20, 1999

[54] THERMAL HEAD WITH BUCKLING EXOTHERMIC RESISTOR AND MANUFACTURING METHOD THEREOF

[75] Inventors: Hirotsugu Matoba, Sakurai; Susumu Hirata, Ikoma-gun; Yorishige Ishii, Yamatotakada; Shingo Abe, Tenri; Hiroshi Onda, Yamatokoriyama; Tetsuya Inui, Nara, all of Japan

[73] Assignee: Sharp Kabushiki Kaisha, Osaka, Japan

[21] Appl. No.: 08/733,824

[22] Filed: Oct. 18, 1996

[30] Foreign Application Priority Data

Oct. 26, 1995 [JP] Japan ..... 7-279160

[51] Int. Cl.[6] ..... B41J 2/335

[52] U.S. Cl. ..... 347/204

[58] Field of Search ..... 347/200, 204, 347/20, 56

[56] References Cited

U.S. PATENT DOCUMENTS 5,666,141 9/1997 Matoba et al. ..... 347/54
5,684,519 11/1997 Matoba et al. ..... 347/20

OTHER PUBLICATIONS

Iwamoto, "Solid–Melting Ink Type (Thermal Transfer) Printer", Photographic Engineering, Special Issue on Imaging, Part 2, published on Jul. 20, 1988, pp. 65–73.

Hayama, "Thermal Head Array", Photographic Engineering, Special Issue on Imaging, Part 3, published on Dec. 20, 1988, pp. 45–54).

*Primary Examiner*—Huan Tran
*Attorney, Agent, or Firm*—Nixon & Vanderhye, P.C.

[57] ABSTRACT

A pair of opposite end portions of a buckling exothermic body as an exothermic resistor are fixed onto a substrate via insulating members. The buckling exothermic body heats with resistance thereof by applying a voltage from a power source to the buckling exothermic body via a switch. As inner temperature of the exothermic resistor reaches a predetermined temperature or higher required for the exothermic resistor to buckle, and a compressive force exceeds a buckling load, the exothermic resistor buckles and distorts towards thermosensible paper from a non-shifted state in which there is virtually no thermal stress. As the buckled and distorted exothermic resistor comes into contact with the thermosensible paper, recording, such as printing, is performed only at the contact portion. This reduces thermal mutual interference between neighboring buckling exothermic bodies. As a result, recording of high resolution and high print quality is performed. Moreover, since, unlike the prior art, there is no need to provide an abrasion protection layer, production costs can be cut down and a smaller and lighter head can be made.

15 Claims, 17 Drawing Sheets

(X)
(Y)
22
24a'
23a
24b'

23

24a
24b

THERMAL HEAD WITH BUCKLING EXOTHERMIC RESISTOR AND MANUFACTURING METHOD THEREOF

FIELD OF THE INVENTION

The present invention relates to a thermal head for recording with joule heat generated by exothermic resistors and a manufacturing method thereof.

BACKGROUND OF THE INVENTION

A thermal head is used for recording with joule heat generated by exothermic resistors disposed so as to form lines separated by equal spaces. Recording methods for the thermal head are classified into two major categories: thermosensitive recording method and thermal transfer recording method. Thermal transfer recording method is further divided into melting type thermal transfer recording method and sublimation type thermal transfer recording method.

Thermosensitive recording method performs recording in the following manner. First, as illustrated in FIG. 21, thermosensible paper 105 is inserted between a platen roller 100 and a thermal head 102 provided with exothermic resistors 101. The thermosensible paper 105 is composed of a colour developing layer 103 and base paper 104. Next, an electric current is supplied to the exothermic resistors 101 of the thermal head 102 so that the exothermic resistors 101 generate joule heat. Then, the colour developing layer 103 develops colour with the joule heat, which in turn forms a visual image on the thermosensible paper 105.

Additionally, in order to fix the visual image, the thermosensible paper 105 may be exposed to ultraviolet ray radiation after being heated in the above manner. This method is called fixing type thermosensitive recording method.

Melting type thermal transfer recording method performs recording in the following manner. First, as illustrated in FIG. 22, transfer film 106 and recording paper 107 (ordinary paper) are inserted between a platen roller 100 and a thermal head 102 provided with exothermic resistors 101. The transfer film 106 is composed of base film 108 and heat melting ink 109 of a relatively low melting point.

Next, an electric current is supplied to the exothermic resistors 101 of the thermal head 102 so that the exothermic resistors 101 generate joule heat, which then heats the transfer film 106. The heat melting ink 109 on the transfer film 106 is thermally transferred to recording paper 107 to form a visual image thereon.

Sublimation type thermal transfer recording method performs recording in the following manner. First, as illustrated in FIG. 23, transfer film 110 and image receiving paper 113 are inserted at the same time between a platen roller 100 and a thermal head 102 provided with exothermic resistors 101. The transfer film 110 is composed of base film 111 and sublimational ink 112. The image receiving paper 113 is composed of dyestuff fixing layer 114 and synthetic paper 115.

Next, an electric current is supplied to the exothermic resistors 101 of the thermal head 102 so that the exothermic resistors 101 generate joule heat, which then heats the transfer film 110. The sublimational ink 112 of the transfer film 110 is thus sublimated. The sublimated sublimational ink 112 is thermally transferred to the dyestuff fixing layer 114 of the image receiving paper 113 to form a visual image thereon.

In FIGS. 21 through 23, the thermal head 102 is shown to be separated from the thermosensible paper 105, the transfer film 106 or the transfer film 110 for convenience in understanding the description. However, the actual thermal head 102 is pressed against the platen roller 100 at a predetermined force via the thermosensible paper 105, the transfer film 106 or the transfer film 110.

FIG. 24 is a simplified structural view of the conventional thermal head 102 employed in the above mentioned methods. The thermal head 102 is provided with a ceramic substrate 123 as shown in a enlarged view of a portion of the upper surface of a main body 122 including a heat radiating plate 121. A glass glaze layer 124 is provided on the ceramic substrate 123. The exothermic resistors 101 are provided on the glaze layer 124 so as to form lines separated by equal spaces.

A selectable electrode 125 is provided on an end of each exothermic resistor 101, whereas a common electrode 126 is provided on the other ends of the exothermic resistors 101. Therefore, any desired exothermic resistor 101 on the glaze layer 124 can be selectively heated when an electric current is supplied to the corresponding selectable electrode 125. The whole surface of the conventional thermal head 102 having such a basic structure is covered with an abrasion protection layer 127.

Ensuring such a thermal head 102 to be in a solid contact with the thermosensible paper 105, the transfer film 106 or the transfer film 110 is essential for high quality printing using the thermal head 102. The glaze layer 124 serves to improve the adhesion between the thermal head 102 and the thermosensible paper 105, the transfer film 106 or the transfer film 110.

Incidentally, since information has an increasingly greater value and role in today's society, there are strong demands for a printer incorporating a thermal head which realizes printing of high resolution and high quality. In order to meet these demands, exothermic resistors provided to the thermal head need to have a smaller width, and besides, spaces between neighbouring exothermic resistors need to be reduced.

Nevertheless, in the conventional thermal head 102, the exothermic resistors 101 are fixed on the ceramic substrate 123 and covered with the abrasion protection layer 127. Therefore, when the neigbouring exothermic resistors 101 are heated at the same time, they thermally interfere each other as a result of heat conduction. Consequently the area having higher temperatures than a predetermined temperature for printing extends unnecessarily around the exothermic resistors 101, which leads to an increase of dot diameters in printing and thus a sharp decline in print quality.

Moreover, in the arrangement of the conventional thermal head 102, the glaze layer 124 and abrasion protection layer 127 leak the joule heat generated by the heated exothermic resistors 101. Therefore, the electric current needs to compensate for that heat loss and still heat the exothermic resistors 101 up to the predetermined temperature, causing greater power consumption.

Furthermore, in the arrangement of the conventional thermal head 102, the provision of the glaze layer 124 only allows a linear portion of the thermal head 102 to come into contact with the thermosensible paper 105, the transfer film 106 or the transfer film 110. Therefore the linear portion (contact portion) wears off easily due to a strong force applied thereto. The whole surface of the thermal head 102 needs to be covered with the abrasion protection layer 127 to eliminate such inconvenience. The provision of the abrasion protection layer 127 pushes up the production costs and creates an obstacle in making a smaller and lighter thermal head 102.

SUMMARY OF THE INVENTION

An object of the present invention is to offer a smaller and lighter thermal head producing high printing quality and reducing power consumption and thermal mutual interference between neighbouring exothermic resistors, and to offer a manufacturing method of such a thermal head.

In order to accomplish the object, a thermal head in accordance with the present invention is characterized in that it includes: a substrate; and exothermic resistors fixed at a pair of opposite end portions thereof onto the substrate, wherein the exothermic resistor thermally expands from a non-shifted state in which there is virtually no thermal stress, and buckles and distorts when inner temperature of the exothermic resistor reaches a predetermined temperature or higher.

With the configuration, the exothermic resistor thermally expands as the inner temperature rises. Since the exothermic resistor is fixed at the opposite end portions thereof onto the substrate, the exothermic resistor cannot freely expands. As a result, a compressive force is accumulated inside. When the inner temperature of the exothermic resistor reaches the predetermined temperature or higher required for the exothermic resistor to buckle, and the compressive force exceeds a buckling load, the exothermic resistor buckles and distorts towards, for example, thermosensible paper from the non-shifted state in which there is virtually no thermal stress. Then recording, such as printing, is performed only at a contact portion by bringing the buckled and deformed exothermic resistor into contact with, for example, a thermosensible medium such as the thermosensible paper and transfer film.

In other words, with the above configuration, unlike in previous art, the whole surface of the exothermic resistor is not fixed to the substrate: the exothermic resistor is fixed only at the opposite end portions thereof to the substrate. Therefore, heat generated by any of the exothermic resistors is prevented from being transmitted to a neighbouring exothermic resistor via the substrate. As a result, the thermal mutual interference between the neighbouring exothermic resistors is reduced.

Hence, the configuration enables neighbouring exothermic resistors to be disposed more closely than in previous art, thereby being capable of making the head smaller. Moreover, since the thermal mutual interference between the neighbouring exothermic resistors is reduced, a printing dot is prevented from expanding. Therefore, recording of high resolution and high printing quality is realized. Furthermore, since the exothermic resistor comes into solid contact with the thermosensible body with the buckling and deformation, recording operation of high quality is realized.

In addition, the exothermic resistor is preferably provided approximately at the center thereof with a protrusion sticking out in the same direction as the exothermic resistor buckles and deforms. With this configuration, the following effects can be achieved.

When the exothermic body buckles and deforms, only the protrusion comes into contact with the thermosensible medium such as thermosensible paper and transfer film. Therefore, only a portion in contact with the protrusion is used as a recording area in printing. In other words, recording such as printing is performed on the thermosensible medium with a dot corresponding to that area of the protrusion. Therefore, the configuration realizes recording of higher resolution and higher print quality.

In addition, the substrate is preferably provided with a guide disposed on the substrate outside each of the opposite end portions of the exothermic resistor and sticking out in the same direction as the exothermic resistor buckles and deforms. With this configuration, the following effects can be achieved.

Since the guides comes into contact with the thermosensible medium such as thermosensible paper and transfer film, even if the thermosensible medium loosens due to, for example, feeding condition, the thermosensible medium does not directly come into contact with the exothermic resistor. Consequently, unlike the prior art, the configuration does not require the exothermic resistor surface to be covered with an abrasion protection layer for preventing the exothermic resistor from wearing off easily. Therefore, with the configuration, since there is no need for an abrasion protection layer, which is essential in the prior art, production costs can be cut down and a smaller and lighter head can be made.

Moreover, with the configuration, since, unlike previous art, no abrasion protection layer is provided, there is no leakage of the heat generated by the exothermic resistor through an abrasion protection layer. Hence, with the configuration, power consumption for heating the exothermic resistor up to a predetermined temperature can be reduced.

Besides, in order to accomplish the object, a method of manufacturing a thermal head in accordance with the present invention is characterized in that it includes processes of: (a) forming a concave portion of a predetermined depth with etching of the substrate; (b) forming a first insulating layer on a bottom of the concave portion; (c) forming a heater layer on the first insulating layer; (d) forming a second insulating layer on the heater layer; and (e) forming a buckling body on the second insulating layer.

With the configuration, the concave portion of the predetermined depth is formed on the substrate with, for example, wet etching of the substrate. Then the first insulating layer is formed on the bottom of the concave portion with, for example, sputtering method. Next the heater layer is formed on the first insulating layer with, for example, sputtering method, and the second insulating layer is formed on the heater layer with, for example, sputtering method. Finally, the buckling body is formed on the second insulating layer with, for example, sputtering method.

In other words, with the configuration, since the exothermic resistor composed of the first insulating layer, heater layer, second insulating layer and buckling body is formed in semiconductor integration process as above, the exothermic body can be made with high precision. Moreover, with the configuration, since the depth of, for example, the concave portion can be easily specified with simple control, relative positions of the thermosensible medium (e.g., thermosensible paper) and the exothermic resistor can be easily specified.

For a fuller understanding of the nature and advantages of the invention, reference should be made to the ensuing detailed description taken in conjunction with the accompanying drawings.

DESCRIPTION OF THE EMBODIMENTS

[First Embodiment]

Referring to FIGS. 1 through 4, the following description will discuss an embodiment in accordance with the present invention.

Figure 1:
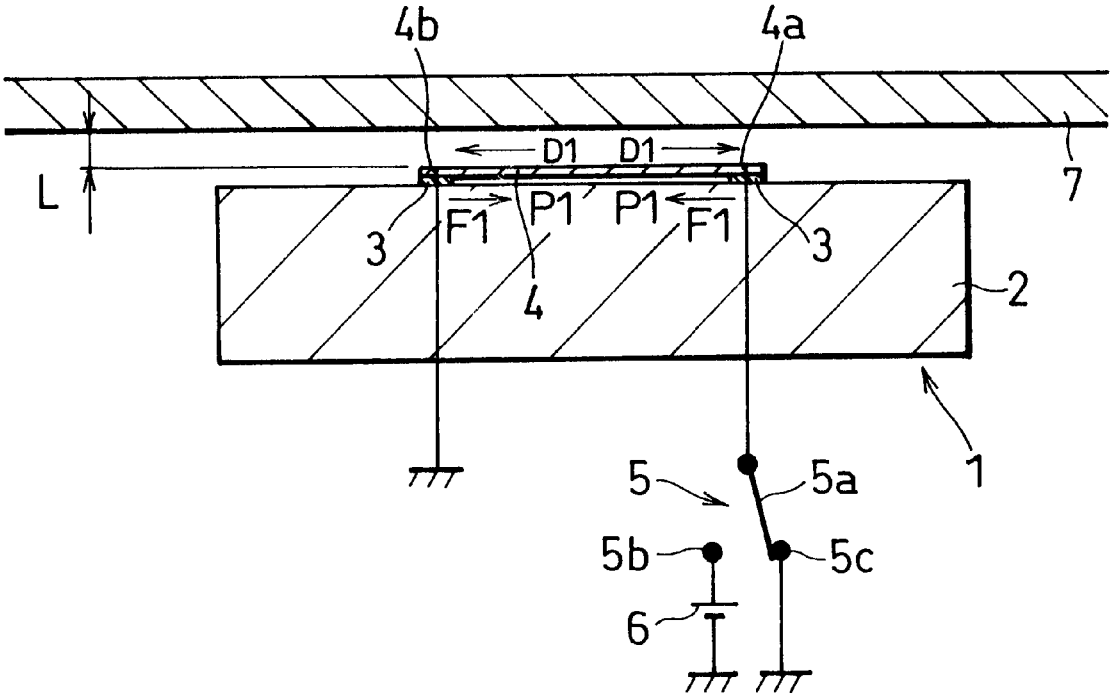
FIG. 1, illustrating a configuration example of a thermal head in accordance with the present invention, is a cross-sectional view showing the thermal head when a buckling exothermic body provided to the thermal head does not yet buckle.
Figure 2:
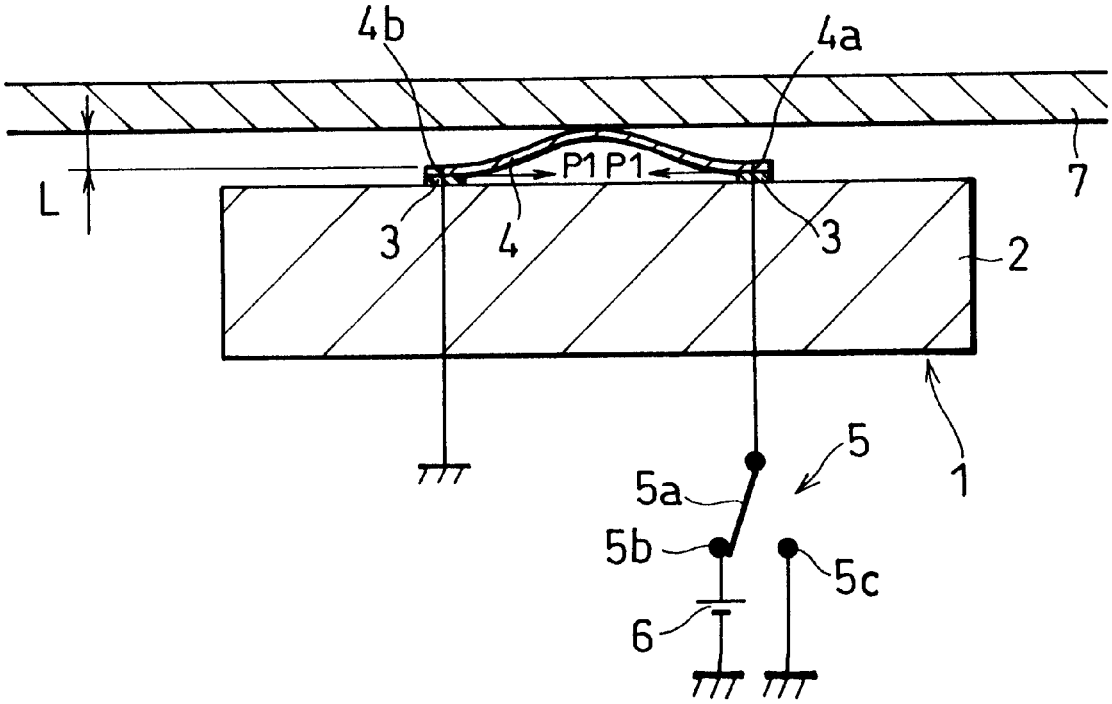
FIG. 2 is a cross-sectional view showing the thermal head when the buckling exothermic body buckles towards thermosensible paper.

FIGS. 1 and 2 are cross-sectional views illustrating a configuration example of a thermal head 1 of the present embodiment. FIG. 1 is a cross-sectional view showing that the thermal head 1 is in a stand-by state in order to carry out recording on recording paper, image receiving paper and the like with thermosensible paper or transfer film. FIG. 2 is a cross-sectional view showing that the thermal head 1 is in a state of carrying out recording (herein after will be referred to as the recording state).

The thermal head 1 of the present embodiment has a substrate 2 as shown in FIGS. 1 and 2. A pair of insulating members 3 are disposed on the upper surface of the substrate 2 so as to face each other and be separated by a predetermined distance. A buckling exothermic body 4 is fixed as an exothermic resistor on this pair of insulating members 3. In other words, the buckling exothermic body 4 is fixed at a pair of opposite end portions thereof onto the substrate 2 via the insulating members 3.

The buckling exothermic body 4 is a horizontally extending quadrangular plate of a conductive and elastic material, such as metal.

An electrode 4*a* and an electrode 4*b* are provided on the respective opposite end portions of the buckling exothermic body 4. The electrodes 4*a* and 4*b* forms a pair of electrodes elegizing the buckling exothermic body 4 in combination with energizing means (will be described later). The electrode 4*a* is connected to a switch 5 as the energizing means at a movable contact point 5*a* thereof, whereas the electrode 4*b* is grounded.

The switch 5 has a pair of fixed contact points 5*b* and 5*c*. The fixed contact point 5*b* is connected to a positive pole of a DC power source 6 as the energizing means, whereas the fixed contact point 5*c* is grounded. Consequently, the electrode 4*a* is connected to the power source 6 with ON operation of the switch 5, that is, with the movable contact point 5*a* of the switch 5 coming into contact with the fixed contact point 5*b*. On the other hand, the electrode 4*a* is disconnected from the power source 6 with OFF operation of the switch 5, that is, with the movable contact point 5*a* of the switch 5 coming into contact with the fixed contact point 5*c*. In short, energizing of the buckling exothermic body 4 is controlled by selecting connection or disconnection between the electrode 4*a* and the power source 6 with respective ON or OFF operation of the movable contact point 5*a* of the switch 5. The buckling exothermic body 4 is energized when in the recording state, and is not energized when in the stand-by state. The energizing means is not limited to the arrangement including the switch 5 and the power source 6. There are various alternatives serving the same purpose.

In the thermal head 1, a small gap L of, for example, 8 $\mu$m is provided between the upper surface of the buckling exothermic body 4 (i.e., the buckling exothermic body 4 surface facing thermosensible paper 7) and the thermosensible paper 7.

The following description will discuss an operation of the thermal head 1 when the thermal head 1 changes from the stand-by state (switch OFF state) to the recording state (switch ON state) with the switching of the movable contact point 5*a* of the switch 5 from the fixed contact point 5*c* side to the fixed contact point 5*b* side.

As the movable contact point 5*a* of the switch 5 is connected to the fixed contact point 5*b,* the electrode 4*a* of the buckling exothermic body 4 is energized by the power source 6. Then, the energized buckling exothermic body 4 heats with resistance thereof, and which will ultimately lead to thermal expansion. In other words, the buckling exothermic body 4 attempts to thermally expand and elongate at least longitudinally and outwardly (denoted as the arrows D1 in FIG. 1).

However, the buckling exothermic body 4, being fixed at the longitudinally opposite end portions thereof onto the substrate 2 via the insulating members 3, can neither expand nor deform. Therefore, compressive forces P1 are applied to the buckling exothermic body 4 inwards (denoted as the arrows F1 in FIG. 1) at the opposite end portions thereof and accumulated inside the buckling exothermic body 4. As the compressive forces Pi become greater than a buckling load Pc of the buckling exothermic body 4, the buckling exothermic body 4 buckles and deforms as shown in FIG. 2. In other words, the buckling exothermic body 4 buckles and deforms in such a manner that the longitudinal mid-portion thereof shifts towards the thermosensible paper 7 and finally comes into contact with the thermosensible paper 7.

In the present embodiment, a heating temperature inside the buckling exothermic body 4 is specified to reach a predetermined temperature (i.e., a colour developing temperature of the thermosensible paper 7) or higher when the buckling exothermic body 4 heats with resistance thereof to an extent that the buckling exothermic body 4 buckles and deforms to come into contact with the thermosensible paper 7. Consequently, recording, such as printing, is carried out only at a portion of the thermosensible paper 7 in contact with the buckling exothermic body 4.

Figure 3A:
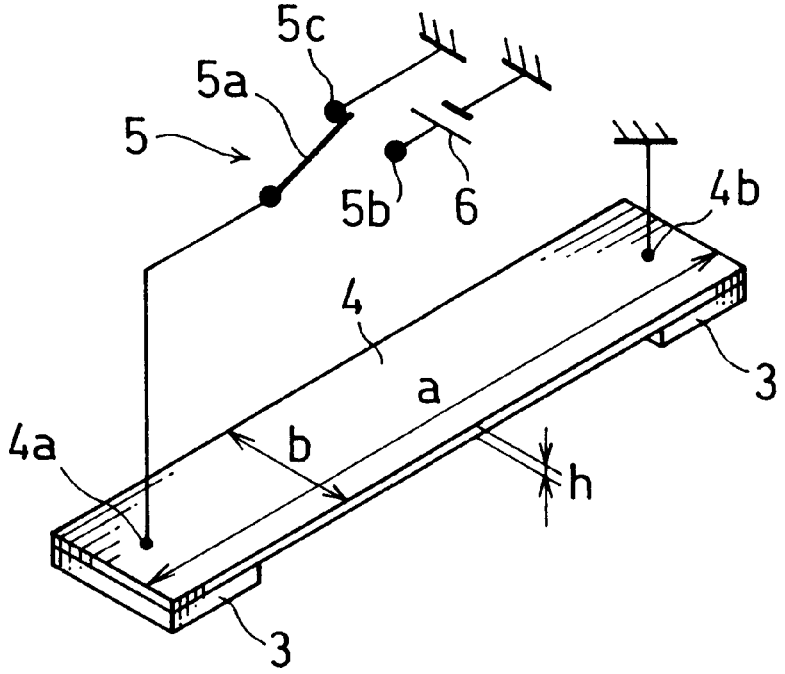
FIG. 3(*a*) is a perspective view showing the buckling exothermic body and the environs thereof when the thermal head in a stand-by state, and FIG. 3(*b*) is a perspective view showing the buckling exothermic body and the environs thereof when the thermal head in a recording state.
Figure 3B:
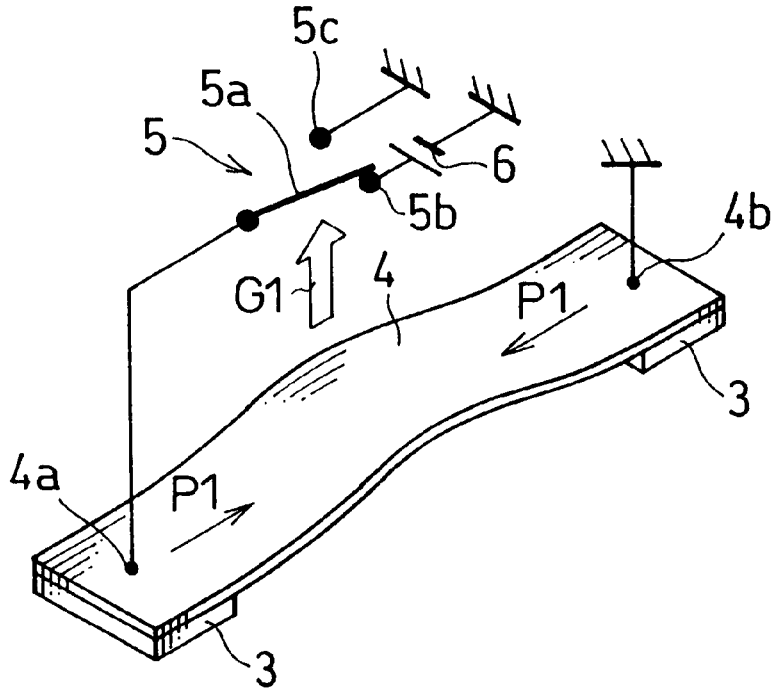

Next, referring to FIGS. 3(*a*), 3(*b*) and 4, the following description will further discuss the buckling and deformation of the buckling exothermic body 4 in more details.

FIGS. 3(*a*) and 3(*b*) are simplified perspective views showing the buckling exothermic body 4 and the environs thereof including the insulating members 3: FIGS. 3(*a*) and 3(*b*) respectively show the stand-by state and the recording state.

As to the buckling exothermic body 4, the compressive force P1 is expressed as:

$$P1=E\cdot\alpha\cdot T\cdot b\cdot h\ (N)$$

where E ($N/m^2$) is Young's modulus, $\alpha$ is a linear expansion coefficient, b (m) is a width, h (m) is a thickness, and T (°C.) is a rise in temperature of the buckling exothermic body 4 heated with resistance thereof when the buckling exothermic body 4 changes from the state shown in FIG. 3(*a*) to the state shown in FIG. 3(*b*), that is, the buckling exothermic body 4 is connected to the power source 6 as a result of operation of the switch 5.

When the compressive forces P1 expressed as above do not exceed the buckling load Pc of the buckling exothermic body 4, the buckling exothermic body 4 neither buckles nor deforms and the compressive forces P1 are accumulated in the buckling exothermic body 4 as an inside stress. On the other hand, when the compressive forces P1 do, the buckling exothermic body 4 buckles and deforms. In other words, when the compressive forces P1 do, the longitudinal mid-portion of the buckling exothermic body 4 shifts towards the thermosensible paper 7 (see FIG. 2), that is, in the direction denoted as the arrow G1 in FIG. 3(*b*).

Besides, since the buckling exothermic body 4 can be regarded as a square pole fixed at the opposite ends thereof with the insulating members 3, the buckling load Pc is expressed as:

$$Pc=\pi^2\ E\cdot b\cdot h^3/3\cdot a^2$$

where a (m) is a length of the buckling exothermic body 4 (see, for example, a technical text book on strength of materials titled "Strength of Materials" by Ohashi Yoshio, Baihukan). Therefore, the buckling exothermic body 4 buckles and deforms when P1>Pc, that is, the temperature rise T of the buckling exothermic body 4 satisfies the condition below:

$$T>\pi^2\cdot h^2/3\cdot\alpha\cdot a^2$$

In other words, for example, supposing that the buckling exothermic body 4 is composed of nickel (Ni) and that the length a, width b and thickness h thereof are 500 $\mu$m, 60 $\mu$m and 5 $\mu$m respectively, the buckling exothermic body 4 buckles and deforms when the temperature rise T is 23° C. or greater.

Figure 4:
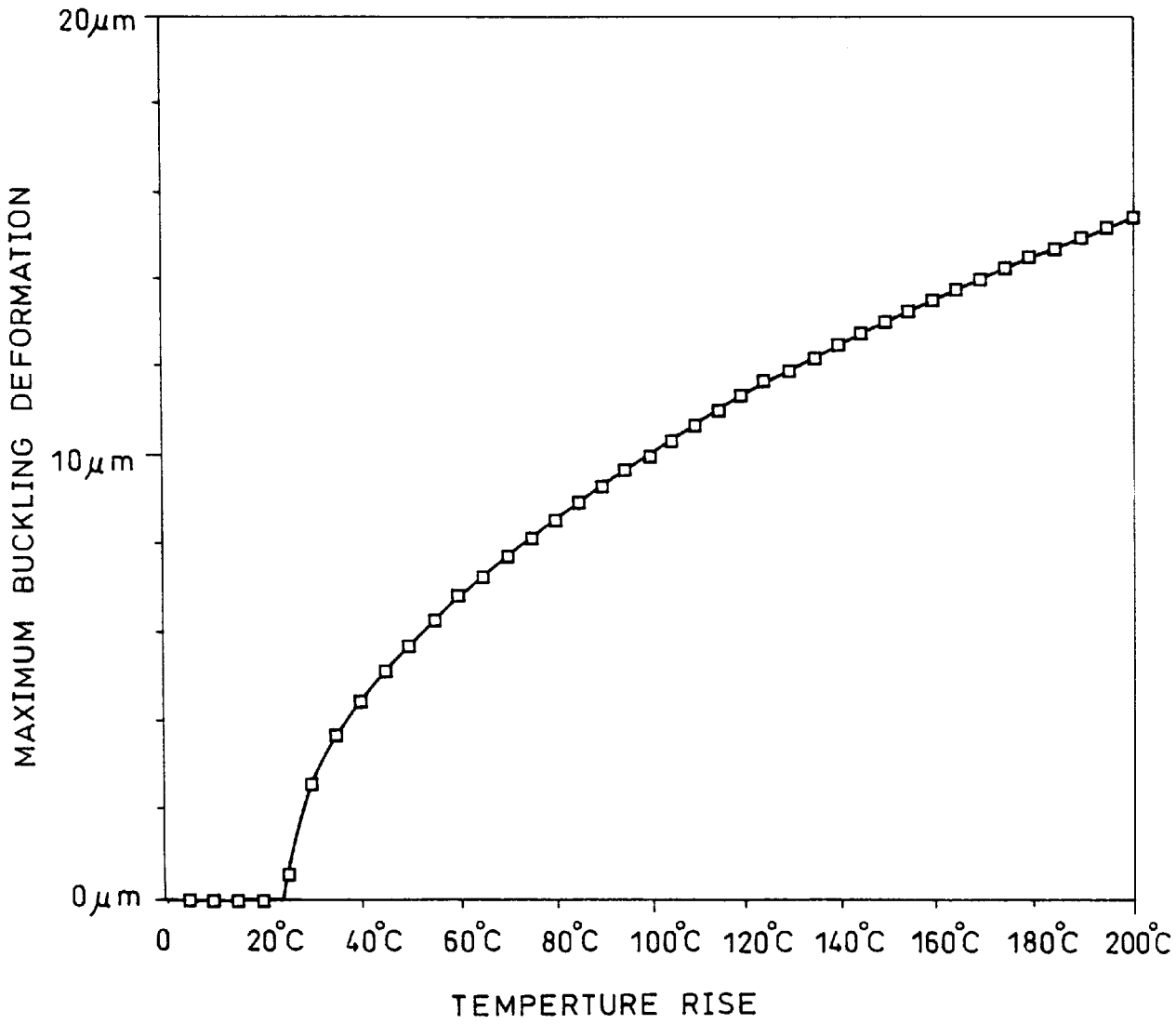
FIG. 4 is a graph showing correlation between temperature rises and maximum buckling deformations of the buckling exothermic body.

Being based on a computer simulation, FIG. 4 shows correlation between temperature rises (axis of abscissas) and maximum buckling deformations (axis of ordinates) of the buckling exothermic body 4 when the buckling exothermic body 4 composed of nickel and having the above mentioned dimensions heats. It is understood from FIG. 4 that the maximum buckling deformation is 13 $\mu$m with a temperature rise of 150° C.

Note also that as to a buckling exothermic body 4 composed of nickel and having free ends, the longitudinal thermal expansion equals 1 $\mu$m at a temperature rise of 150° C., using with room temperature of 20° C. as the reference. The figure shows that the buckling deformation is greater by far than the thermal expansion at the same heating temperature.

With the above configuration, since the buckling exothermic body 4 is fixed only at the opposite end portions thereof onto the substrate 2 via the insulating members 3, the other portions of the buckling exothermic body 4 facing the substrate 2 are separated from the substrate 2 by predetermined gaps. This prevents heat generated by any of the buckling exothermic bodies 4 selectively energized by the power source 6 from being transmitted to a neighbouring buckling exothermic body 4 via the substrate 2. As a result, the thermal mutual interference is reduced between the neighbouring buckling exothermic bodies 4.

The above configuration thus allows a space between the neighbouring buckling exothermic bodies 4 to be smaller than in previous art, thereby facilitating realization of a smaller head. In addition, since the thermal mutual interference is reduced between the neighbouring buckling exothermic bodies 4, the printing dot does not expand. Recording of high resolution and high printing quality is realized in this manner.

Moreover, with the above configuration, a small longitudinal variation of the buckling exothermic body 4 is transformed into a large variation in thickness. This ensures a solid contact between the buckling exothermic body 4 and the thermosensible paper 7. Therefore, a high quality recording operation is realized by utilizing this kind of buckling phenomena.

[Second Embodiment ]

Figure 5:
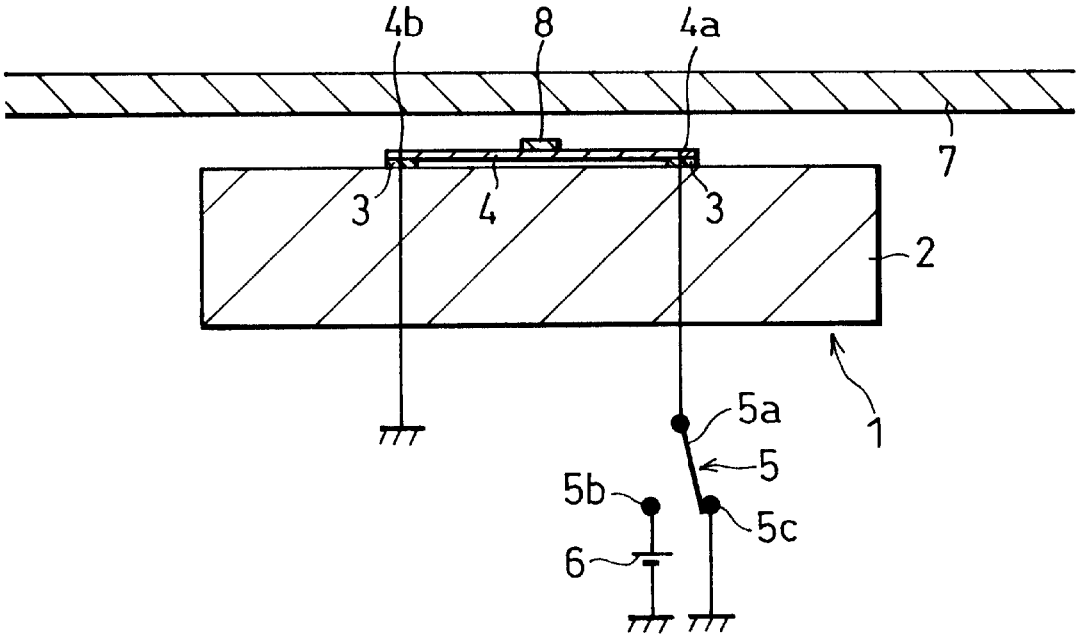
FIG. 5 illustrating another configuration example of the thermal head, is a cross-sectional view showing the thermal head when a buckling exothermic body provided to the thermal head does not yet buckle.
Figure 6:
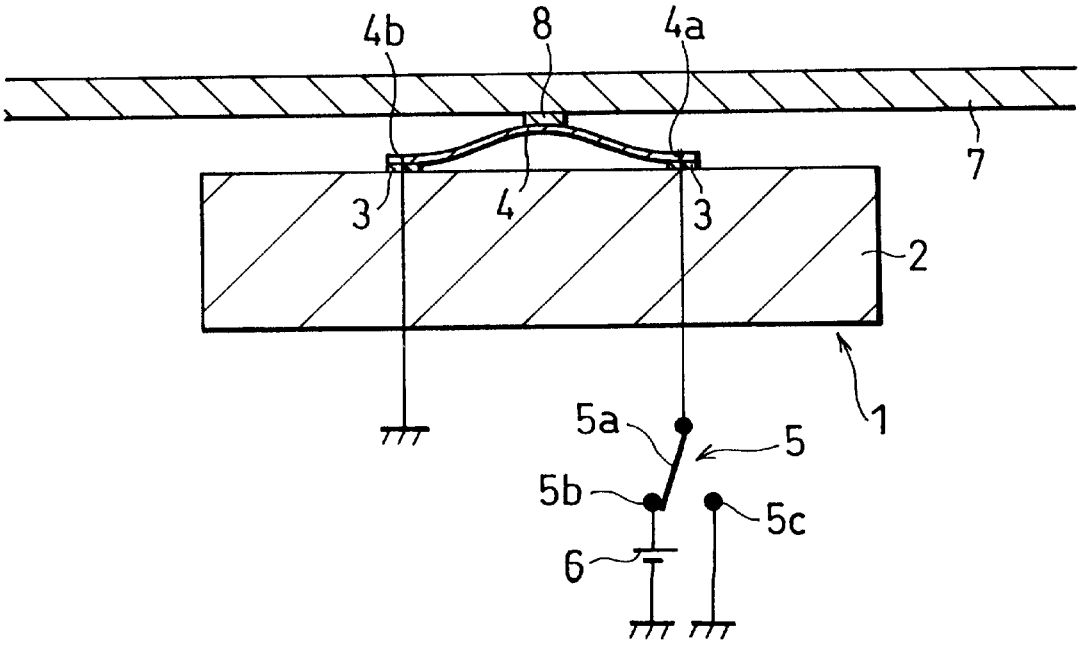
FIG. 6 is a cross-sectional view showing the thermal head when the buckling exothermic body buckles towards thermosensible paper.

Referring to FIGS. 5 and 6, the following description will discuss another embodiment of the present invention. Here, for convenience, members of the second embodiment that have the same arrangement and function as members of the first embodiment, and that are mentioned in the first embodiment are indicated by the same reference numerals and description thereof is omitted.

FIGS. 5 and 6 are cross-sectional views illustrating another configuration example of the thermal head 1 in accordance with the present invention: FIG. 5 is a cross-sectional view showing the thermal head 1 in the stand-by state, whereas FIG. 6 is a cross-sectional view showing the thermal head 1 in the recording state. The thermal head 1 of the present embodiment is provided approximately at the center of the buckling exothermic body 4 with a protrusion 8 sticking out towards the thermosensible paper 7. The other parts of the thermal head 1 are configured in exactly the same manner as in the first embodiment. Hence, the following description will focus on operation of the thermal head 1, and discussion on the configuration thereof is omitted.

As the thermal head 1 changes from the stand-by state (switch OFF state) to the recording state (switch ON state) with the switching of the movable contact point 5*a* of the switch 5 from the fixed contact point 5*c* side to the fixed contact point 5*b* side, the electrode 4*a* of the buckling exothermic body 4 is energized by the power source 6. Then the energized buckling exothermic body 4 buckles and deforms as mentioned in the first embodiment (see FIG. 6). In other words, the buckling exothermic body 4 buckles and deforms in such a manner that the longitudinal mid-portion thereof shifts towards the thermosensible paper 7 and finally comes into contact with the thermosensible paper 7. However, since the protrusion 8 is provided to the buckling exothermic body 4 approximately at the center thereof, only the protrusion 8 comes into contact with the thermosensible paper 7.

With the above configuration, when the buckling exothermic body 4 buckles and deforms, only the protrusion 8 comes into contact with the thermosensible paper 7. Therefore, only a portion in contact with the protrusion 8 is used as a recording area in printing. In other words, recording such as printing is performed on the thermosensible paper 7 with a dot corresponding to that area of the protrusion 8. Therefore, the configuration realizes recording of higher resolution and higher print quality.

[Third Embodiment]

Figure 7:
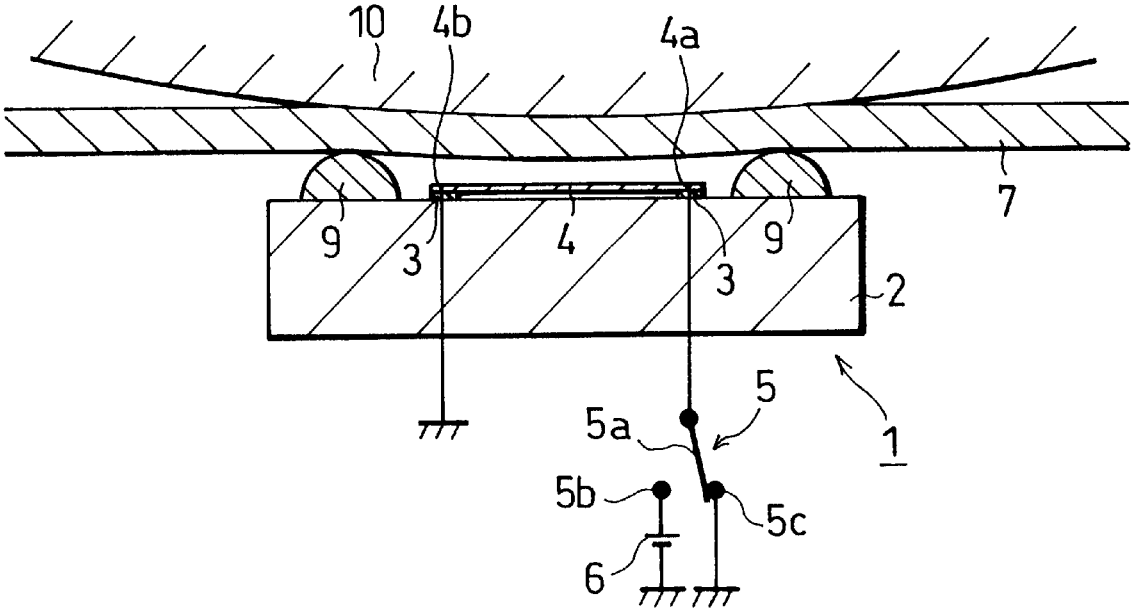
FIG. 7, illustrating a further configuration example of the thermal head, is a cross-sectional view showing the thermal head when a buckling exothermic body provided to the thermal head does not yet buckle.
Figure 8:
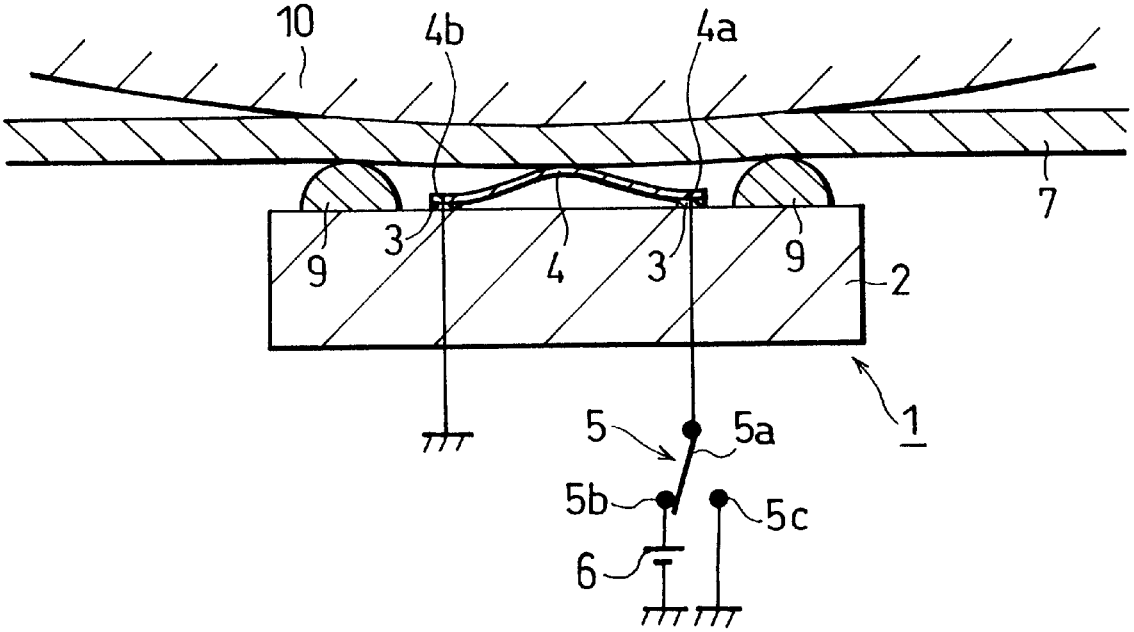
FIG. 8 is a cross-sectional view showing the thermal head when the buckling exothermic body buckles towards thermosensible paper.

Referring to FIGS. 7 and 8, the following description will discuss a further embodiment of the present invention. Here, for convenience, members of the third embodiment that have the same arrangement and function as members of the first and second embodiments, and that are mentioned in the first and second embodiments are indicated by the same reference numerals and description thereof is omitted.

FIGS. 7 and 8 are cross-sectional views illustrating a further configuration example of the thermal head 1 in accordance with the present invention: FIG. 7 is a cross-sectional view showing the thermal head 1 in the stand-by state, whereas FIG. 8 is a cross-sectional view showing the thermal head 1 in the recording state.

The thermal head 1 of the present embodiment is provided with at least a pair of guides 9. The guides 9 are disposed on the substrate 2 outside the buckling exothermic body 4 so as to sandwich the buckling exothermic body 4 and stand higher than the buckling exothermic body 4 towards the thermosensible paper 7. The guides 9 thus allow the buckling exothermic body 4 to face the thermosensible paper 7 with a small gap of, for example, 8 $\mu$m therebetween. The other parts of the thermal head 1 are configured in exactly the same manner as in the first embodiment. Hence, the following description will focus on operation of the thermal head 1, and discussion on the configuration thereof is omitted.

The thermal head 1 is pressed against the platen roller 10 via the thermosensible paper 7 in the stand-by state shown in FIG. 7. As a result the pair of guides 9 provided to the thermal head 1 are in contact with the thermosensible paper 7.

Next, as the thermal head 1 changes from the stand-by state (switch OFF state) to the recording state (switch ON state) with the switching of the movable contact point 5*a* of the switch 5 from the fixed contact point 5*c* side to the fixed contact point 5*b* side, the electrode 4*a* of the buckling exothermic body 4 is energized by the power source 6. Then the energized buckling exothermic body 4 buckles and deforms as mentioned in the first embodiment (see FIG. 8). In other words, the buckling exothermic body 4 buckles and deforms in such a manner that the longitudinal mid-portion thereof shifts towards the thermosensible paper 7 and finally comes into contact with the thermosensible paper 7. However, since the guides 9 are provided to the thermal head 1, the thermosensible paper 7 between the guides 9 is fed without being loose.

With the above configuration, even if the thermosensible paper 7 loosens accidentally due to feeding condition, the thermosensible paper 7 between the guides 9 does not loosen. Therefore, the thermosensible paper 7 can be prevented from coming into contact with the buckling exothermic body 4 due to feeding condition. Consequently, unlike the prior art, the configuration does not require the buckling exothermic body 4 to be covered with an abrasion protection layer.

In other words, conventionally, the exothermic resistor is covered with an abrasion protection layer so as not to be worn out easily by the thermosensible paper 7 coming into contact with the exothermic resistor due to feeding condition. On the contrary, according to the configuration of the present embodiment, the guides 9 much smaller than such an abrasion protection layer can prevent the thermosensible paper 7 from coming into contact with the buckling exothermic body 4 due to feeding condition, thereby eliminating the need for the abrasion protection layer to be provided to cover the whole surface of the buckling exothermic body 4.

Therefore, with the configuration, since there is no need for an abrasion protection layer, which is essential in the prior art, production costs can be cut down and a smaller and lighter head can be made. Moreover, since, unlike the prior art, there is no leakage of heat through an abrasion protection layer, power consumption for heating the exothermic resistor, such as the buckling exothermic body 4, up to the predetermined temperature is more surely reduced than in previous art.

Note also that if the guides 9 are specified to be of about the same height as buckling deformation of the buckling exothermic body 4 towards the thermosensible paper 7, a simple structure enables the standing-by buckling exothermic body 4 to face the thermosensible paper 7 with a predetermined gap therebetween.

[Fourth Embodiment]

Figure 9:
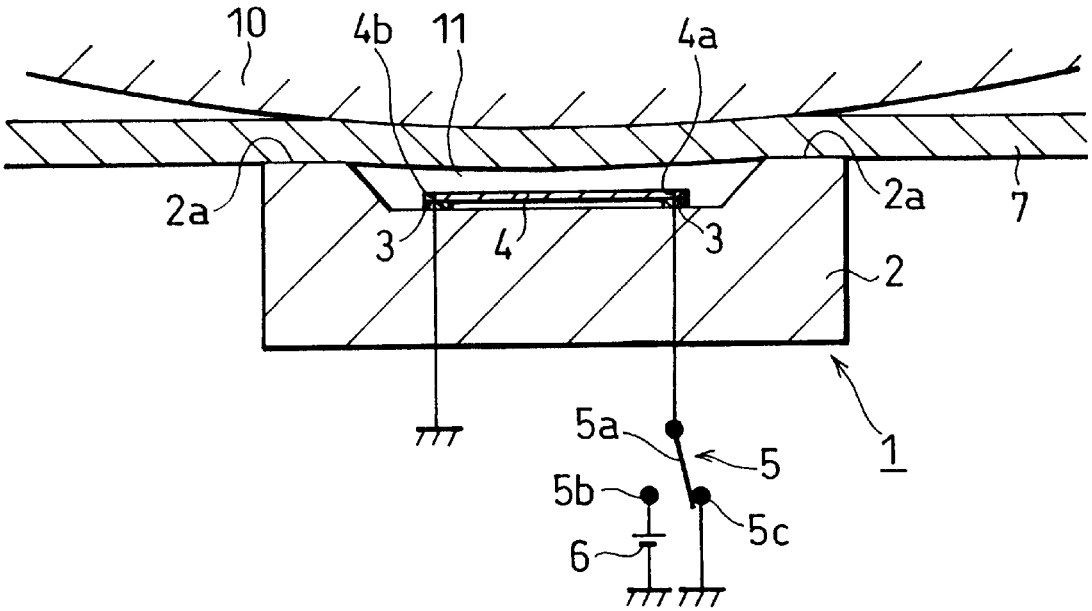
FIG. 9, illustrating even another configuration example of the thermal head, is a cross-sectional view showing the thermal head when a buckling exothermic body provided to the thermal head does not yet buckle.
Figure 10:
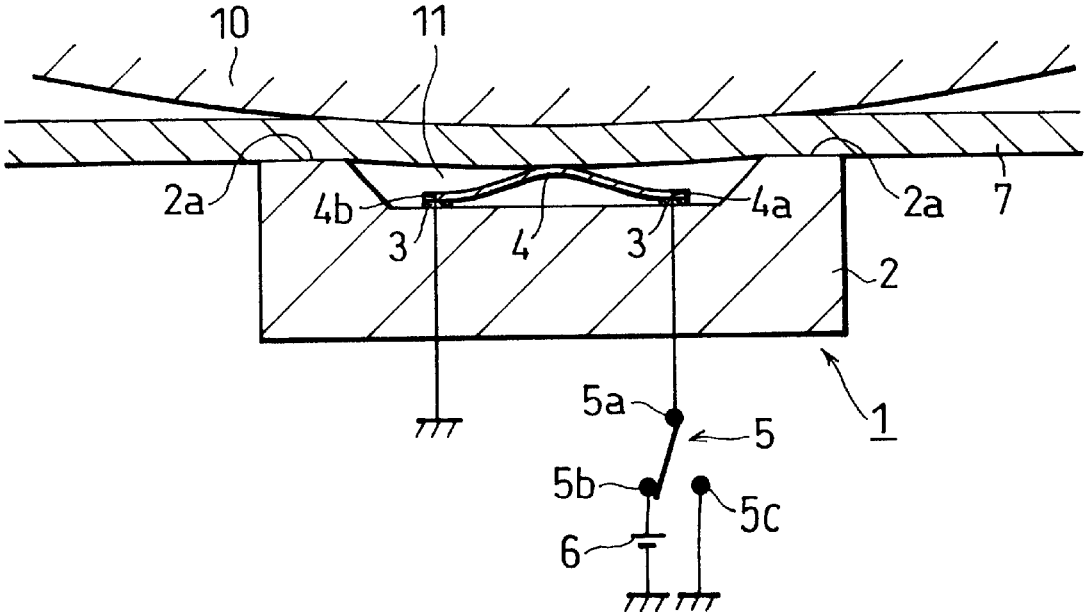
FIG. 10 is a cross-sectional view showing the thermal head when the buckling exothermic body buckles towards thermosensible paper.

Referring to FIGS. 9 and 10, the following description will discuss an even another embodiment of the present invention. Here, for convenience, members of the fourth embodiment that have the same arrangement and function as members of the first through third embodiments, and that are mentioned in the first through third embodiments are indicated by the same reference numerals and description thereof is omitted.

FIGS. 9 and 10 are cross-sectional views illustrating even another configuration example of the thermal head 1 in accordance with the present invention: FIG. 9 is a cross-sectional view showing the thermal head 1 in the stand-by state, whereas FIG. 10 is a cross-sectional view showing the thermal head 1 in the recording state.

The thermal head 1 of the third embodiment is configured to include at least a pair of guides 9 (see FIGS. 7 and 8) provided on the substrate 2. On the contrary, as shown in FIGS. 9 and 10, the thermal head 1 of the present embodiment is configured to include a concave portion 11 in which the buckling exothermic body 4 is disposed. The concave portion 11 is formed by carving a part of the upper surface of the substrate 2 to a predetermined depth (for example, 8 μm). The other parts of the thermal head 1 are configured in exactly the same manner as in the first embodiment. Hence, the following description will focus on operation of the thermal head 1, and discussion on the configuration thereof is omitted.

The thermal head 1 is pressed against the platen roller 10 via the thermosensible paper 7 in the stand-by state shown in FIG. 9. As a result, upper surfaces 2*a* at a pair of opposite end portions of the substrate 2 are in contact with the thermosensible paper 7. The buckling exothermic body 4 faces the thermosensible paper 7 with a small gap therebetween. The gap is approximately equal to the depth of the concave portion 11.

Next, as the thermal head 1 changes from the stand-by state (switch OFF state) to the recording state (switch ON state) with the switching of the movable contact point 5*a* of the switch 5 from the fixed contact point 5*c* side to the fixed contact point 5*b* side, the electrode 4*a* of the buckling exothermic body 4 is energized by the power source 6. Then the energized buckling exothermic body 4 buckles and deforms as mentioned in the first embodiment (see FIG. 10). In other words, the buckling exothermic body 4 buckles and deforms in such a manner that the longitudinal mid-portion thereof shifts towards the thermosensible paper 7 and finally comes into contact with the thermosensible paper 7. However, since the upper surfaces 2*a* of the substrate 2 are in contact with the thermosensible paper 7, the thermosensible paper 7 between the upper surfaces 2*a* is fed without being loose.

With the above configuration, the upper surfaces 2*a* formed by carving a part of the upper surface of the substrate 2 have the same functions as the guides 9 in the third embodiment. Therefore, the configuration in which the buckling exothermic body 4 is disposed in the concave portion 11 as in the present embodiment produces the same effects as the third embodiment.

Note also that the above mentioned effects can be enhanced by a configuration in which both the guides 9 employed in the third embodiment and the concave portion 11 are provided on the front side of the substrate 2.

[Fifth Embodiment]

Referring to FIGS. 11 through 15, the following description will discuss a yet another embodiment of the present invention. Here, for convenience, members of the fifth embodiment that have the same arrangement and function as members of the first through fourth embodiments, and that are mentioned in the first through fourth embodiments are indicated by the same reference numerals and description thereof is omitted.

Figure 11:
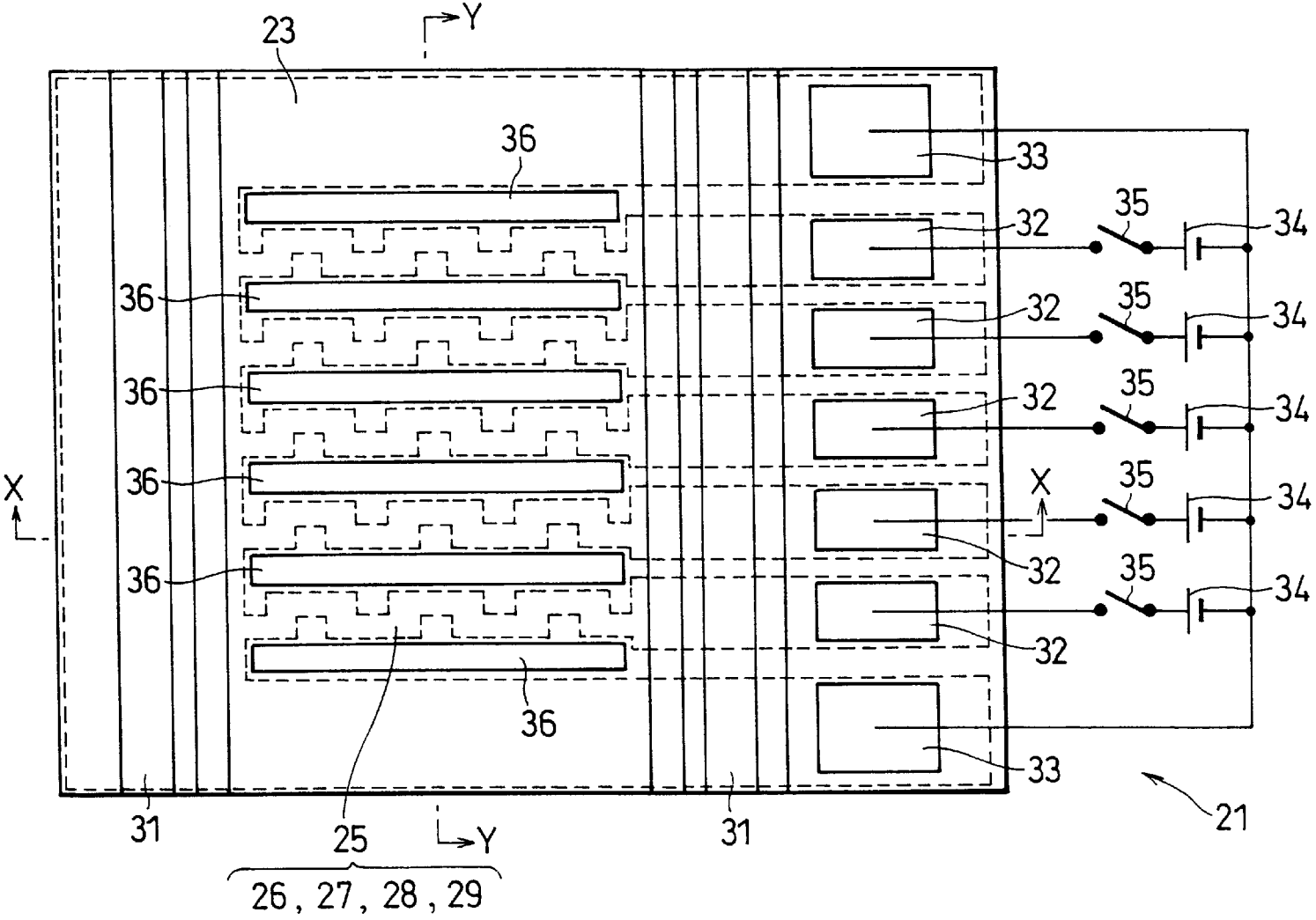
FIG. 11 is a plan view illustrating yet another configuration example of the thermal head.
Figure 12:
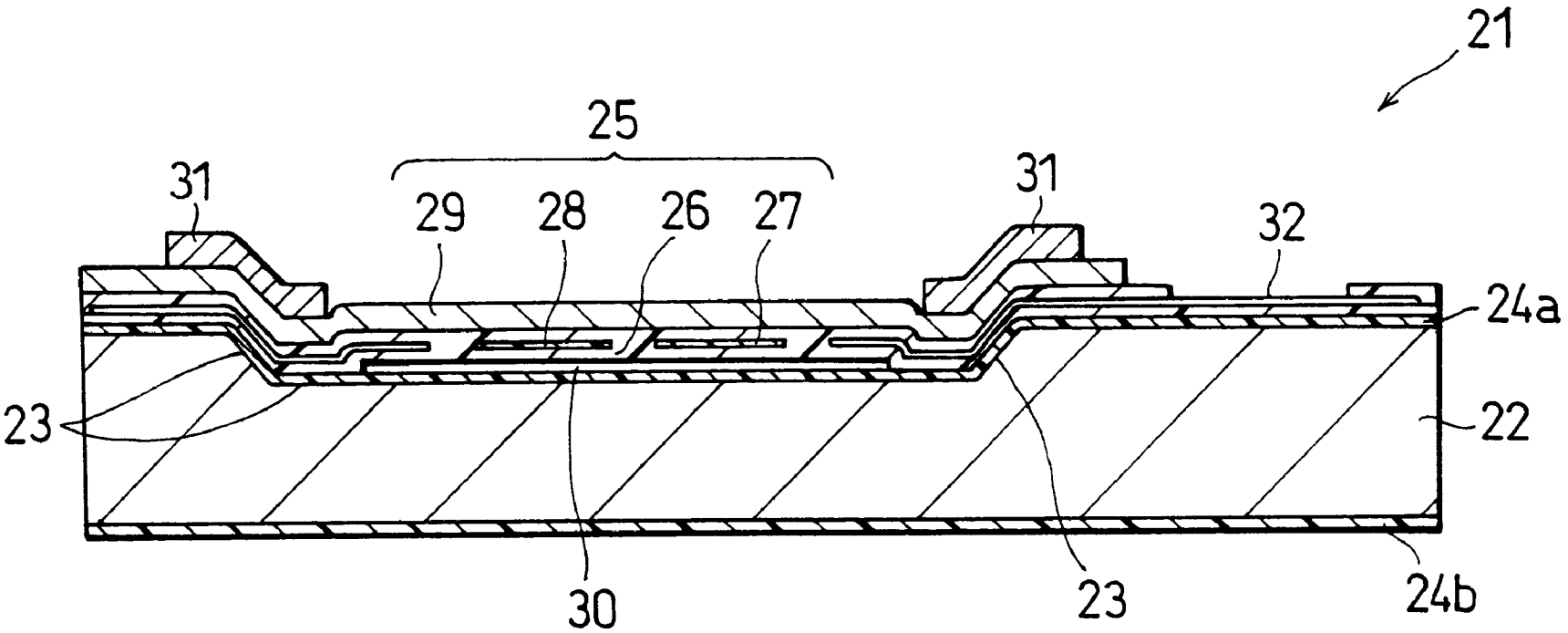
FIG. 12 is a cross-sectional view taken along line X—X shown in FIG. 11.
Figure 13:
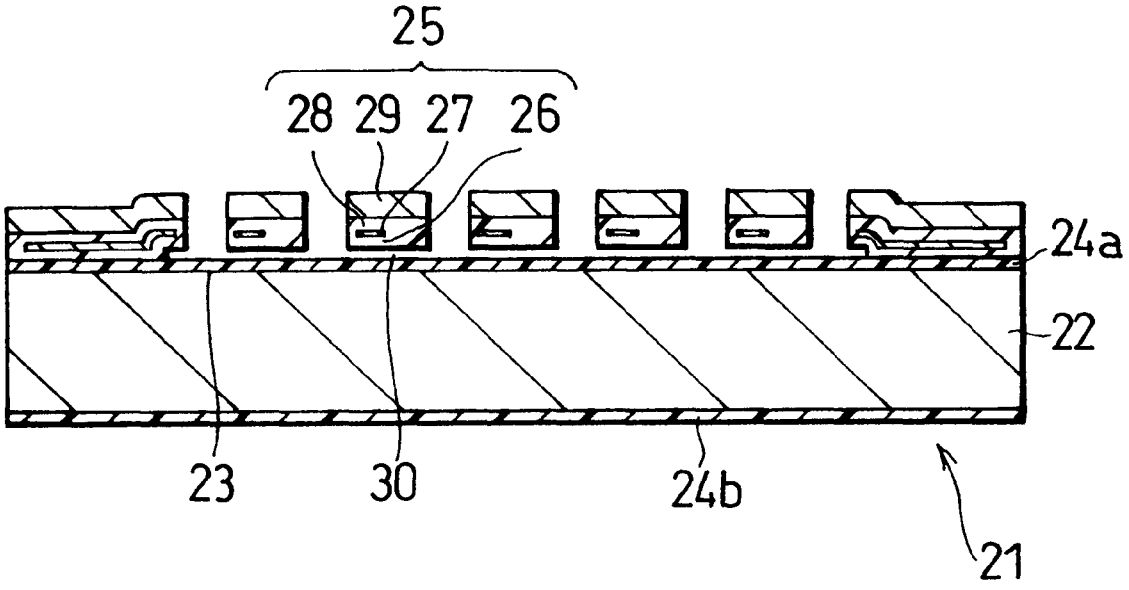
FIG. 13 is a cross-sectional view taken along line Y—Y shown in FIG. 11.

FIG. 11 is a plan view specifically illustrating a configuration of a thermal head 21 in accordance with the present invention. FIG. 12 is a cross-sectional view taken along line X—X shown in FIG. 11, whereas FIG. 13 is a cross-sectional view taken along line Y—Y shown in FIG. 11.

In the thermal head 21 of the present embodiment, a concave portion 23 having a taper shape is provided on the front side of a substrate 22. The concave portion 23 produces the same effects as the concave portion 11 explained in the fourth embodiment (see FIGS. 9 and 10). A surface insulating layer 24*a* and a plurality of buckling exothermic bodies 25 are laminated in this order on the surface of the concave portion 23. Five buckling exothermic bodies 25 are used in the present embodiment.

The buckling exothermic body 25 is composed of a film-like first insulating layer 26, a heater layer 27, a film-like second insulating layer 28 and a buckling body 29 which are formed in this order on the surface insulating layer 24*a*. Nevertheless, a gap 30 of a predetermined distance (for example, 0.5 μm) is provided to partly separate the surface insulating layer 24*a* and the buckling exothermic body 25. A surface insulating layer 24*b* is provided on the back side of the substrate 22.

A pair of guides 31 are provided on longitudinally opposite end portions of the buckling exothermic body 25. The guides 31 produce the same effects as the guides 9 employed in the third embodiment.

An operation electrode 32 and a common electrode 33 are provided to connect the heater layer 27 to external electric means. An electric current from a power source 34 is supplied to the first insulating layer 26 and the surface insulating layer 24*a* via the operation electrode 32 and the common electrode 33. The electric current supply from the power source 34 is controlled with ON/OFF operation of the switch 35. The buckling exothermic bodies 25 are separated from each other by slits 36.

The following description will discuss operation of the thermal head 21.

Figure 14:
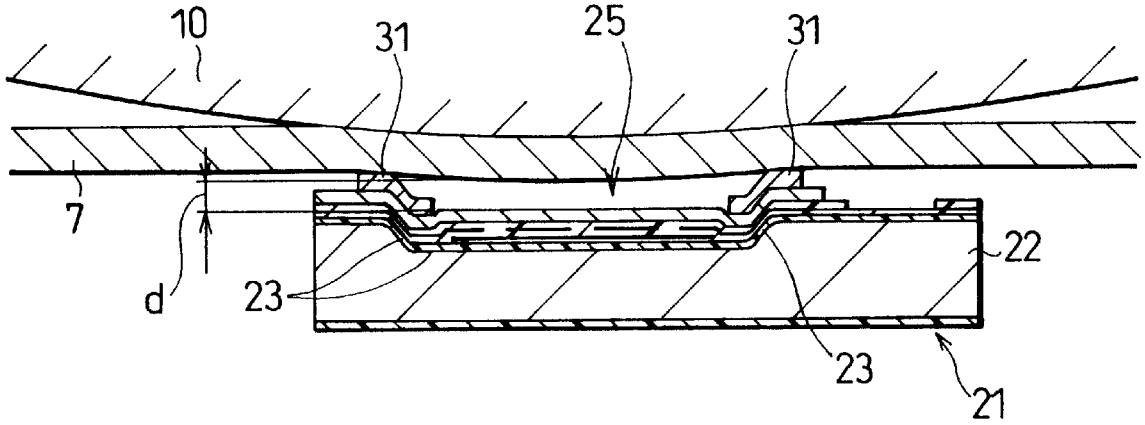
FIG. 14 is a cross-sectional view showing the thermal head when a buckling exothermic body provided to the thermal head does not yet buckle.
Figure 15:
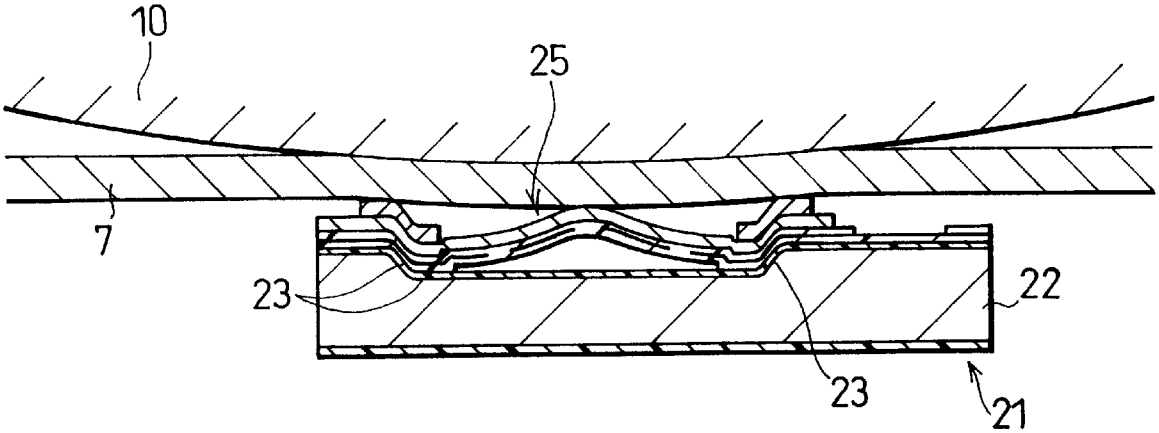
FIG. 15 is a cross-sectional view showing the thermal head when the buckling exothermic body buckles towards thermosensible paper.

FIGS. 14 and 15 are cross-sectional views showing relative positions of the thermal head 21, the thermosensible paper 7 and the platen roller 10: FIG. 14 is a cross-sectional view showing the thermal head 21 in the stand-by state, whereas FIG. 15 is a cross-sectional view showing the thermal head 21 in the recording state.

The thermal head 21 is pressed against the platen roller 10 via the thermosensible paper 7 in the stand-by state as shown in FIG. 14. As a result, the guides 31 of the thermal head 21 are in contact with the thermosensible paper 7. The buckling exothermic body 25 faces the thermosensible paper 7 with a small gap d (for example, 8 μm) therebetween. The small gap d is determined according to a thickness of the guides 31 and a depth of the concave portion 23.

When recording, the switches 35 shown in FIG. 11 corresponding to the necessary buckling exothermic bodies 25 for recording, such as printing, are selectively turned on. A voltage from the power source 34 is thereby applied to the operation electrode 32 and the common electrode 33. As the electric current flows through the heater layer 27 of the buckling exothermic body 25, the heater layer 27 heats with resistance thereof. The heat generated by the heater layer 27 is transmitted via the second insulating layer 28 to the buckling body 29 composing the buckling exothermic body 25, which buckles and distorts as shown in FIG. 15. In other words, the buckling exothermic body 25 buckles and deforms in such a manner that the longitudinal mid-portion thereof shifts towards the thermosensible paper 7 and finally comes into contact with the thermosensible paper 7.

In the present embodiment, a heating temperature inside the buckling exothermic body 25 is specified to reach a predetermined temperature (i.e., a colour developing temperature of the thermosensible paper 7) or higher when the buckling exothermic body 25 heats with resistance thereof to an extent that the buckling exothermic body 25 buckles and deforms to come into contact with the thermosensible paper 7. Consequently, recording, such as printing, is carried out only at a portion of the thermosensible paper 7 in contact with the buckling exothermic body 4.

A thermal head array having five buckling exothermic bodies 25 is employed in the present embodiment for a simple description. Nonetheless, the number of the buckling exothermic bodies 25 is not limited to this: any number of buckling exothermic bodies 25 can be employed.

As discussed so far, the thermal head 21 of the present embodiment is characterized in that it includes: a substrate 22 with a concave portion 23 of a predetermined depth; and at least one buckling exothermic body 25 disposed on the bottom of the concave portion 23, wherein the buckling exothermic body 25 is composed of at least a first insulating layer 26, a heater layer 27, a second insulating layer 28 and a buckling body 29 laminated in this order, and when the buckling body 29 is heated by the heater layer 27 up to a predetermined temperature or higher, the buckling body 29 thermally expands from a non-shifted state in which there is virtually no thermal stress, and buckles and distorts.

With the configuration, the buckling exothermic body 25 thermally expands as the inner temperature rises. When the heater layer 27 of the buckling exothermic body 25 heats the buckling body 29 up to the predetermined temperature or higher, the buckling body 29 thermally expands towards the thermosensible paper 7 from a non-shifted state in which there is virtually no thermal stress, and buckles and distorts. As the buckled and distorted buckling exothermic body 25 comes into contact with the thermosensible paper 7, recording, such as printing, is performed only at the contact portion.

In other words, since the buckling exothermic body 25 is configured to include the heater layer 27 and the buckling body 29, recording operation of high quality as in the first embodiment can be performed by buckling and distorting the buckling body 29 with heating of the heater layer 27.

Moreover, the guides 31 are provided on the opposite end portions of the buckling exothermic body 25 and stick out in the direction that the buckling exothermic body 25 buckles and distorts. As a result, even if the thermosensible paper 7 loosens due to feeding condition, the thermosensible paper 7 between the guides 31 does not loosen. The thermosensible paper 7 can be thereby prevented from coming into contact with the buckling exothermic body 25 due to feeding condition.

Consequently, since the configuration, unlike the prior art, does not require the buckling exothermic body 25 to be covered with an abrasion protection layer, production costs can be cut down and a smaller and lighter head can be made. Moreover, since unlike the prior art, there is no abrasion protection layer leaking out heat, power consumption for heating the exothermic resistor, such as the buckling exothermic body 25, up to the predetermined temperature is more surely reduced than in previous art.

Note also that if the positions of the upper surfaces of the guides 31 are almost the same as the highest position of the buckling exothermic body 25 when the buckling exothermic body 25 buckles and distorts, a simple structure enables the standing-by buckling exothermic body 25 to face the thermosensible paper 7 with a predetermined gap therebetween.

Figures 16A, 16B, 16C:
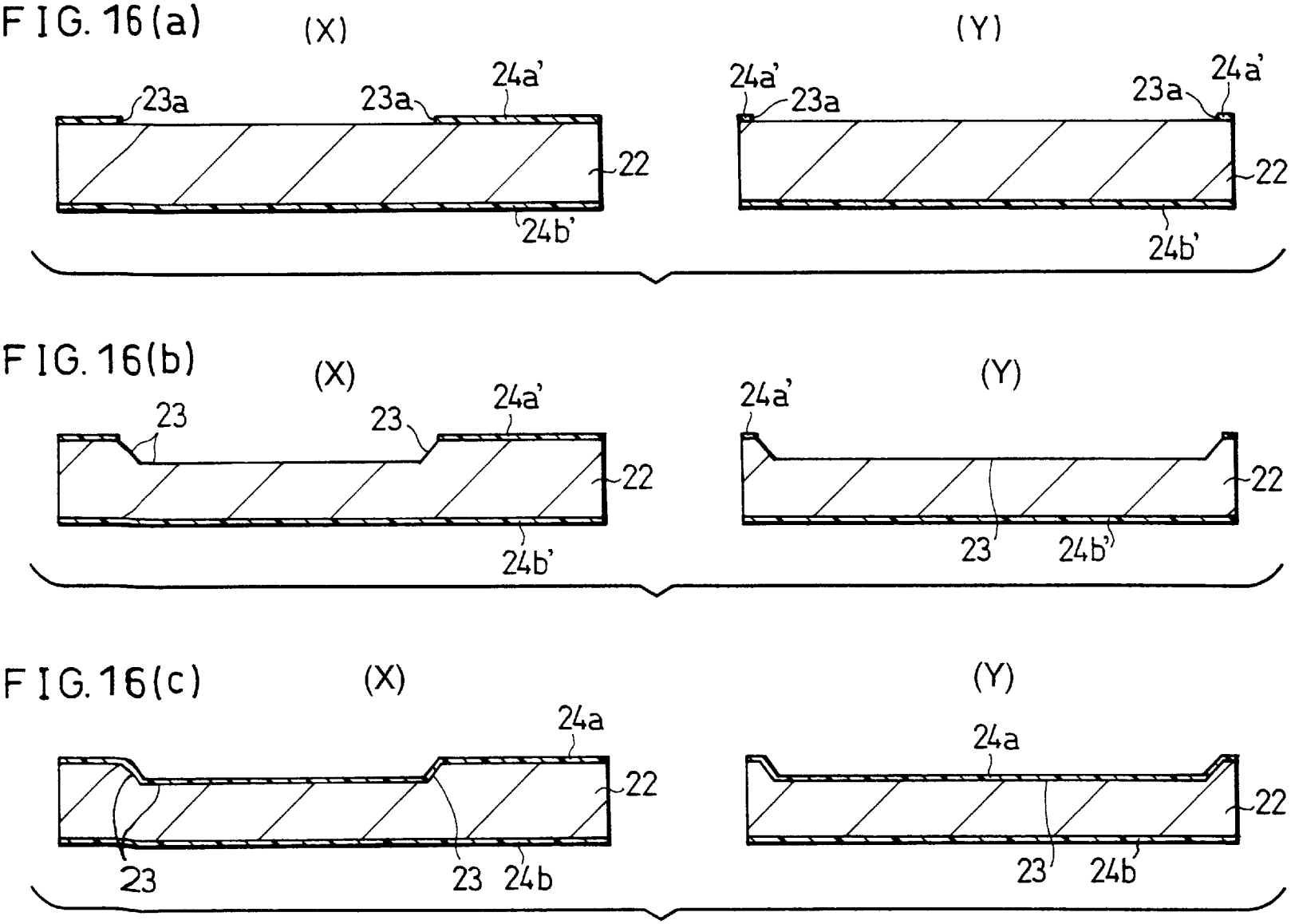
FIGS. 16(*a*) through 16(*c*) are cross-sectional views showing a manufacturing process of the thermal head.

Referring to FIGS. 16(*a*) through 16(*c*), 17(*d*) through 17(*f*), 18(*g*) through 18(*i*), 19(*j*) through 19(*l*), 20(*m*) and 20(*n*), the following description will discuss manufacturing processes of the thermal head 21 of the present embodiment. (X) and (Y) in these figures represent cross-sectional views taken along line X—X shown in FIG. 11 and cross-sectional views taken along line Y—Y shown in FIG. 11 respectively.

Firstly, as shown in FIG. 16(*a*), thermally oxidated films 24*a*′ and 24*b*′ are formed with thermal oxidation respectively on the front and back sides of the substrate 22 composed of silicon having crystal orientation (100). Then photoresist (not shown) is applied on the front side of the substrate 22. Next a quadrangular aperture corresponding to the concave portion 23 shown in FIGS. 11 and 12 is formed by patterning the photoresist with photolithography technique. A quadrangular aperture 23*a* is formed in the thermally oxidated film 24*a*′ with dry etching method using, for example, $CH_3$ gas.

Secondly, as shown in FIG. 16(*b*), the substrate 22 is dipped in a potassium hydroxide solution. The substrate 22 is treated with wet etching method from the front side to the back side thereof, using the thermally oxidated film 24*a*′ with the aperture 23*a* as a mask, in order to form the concave portion 23 of a predetermined depth (for example, 6 μm). Thereafter, the thermally oxidated films 24*a*′ and 24*b*′ are removed.

Next, as shown in FIG. 16(*c*), surface insulating layers 24*a* and 24*b* of predetermined thicknesses (for example, 1 μm) are again formed with thermal oxidation respectively on the front and back sides of the substrate 22.

Figures 17D, 17E, 17F:
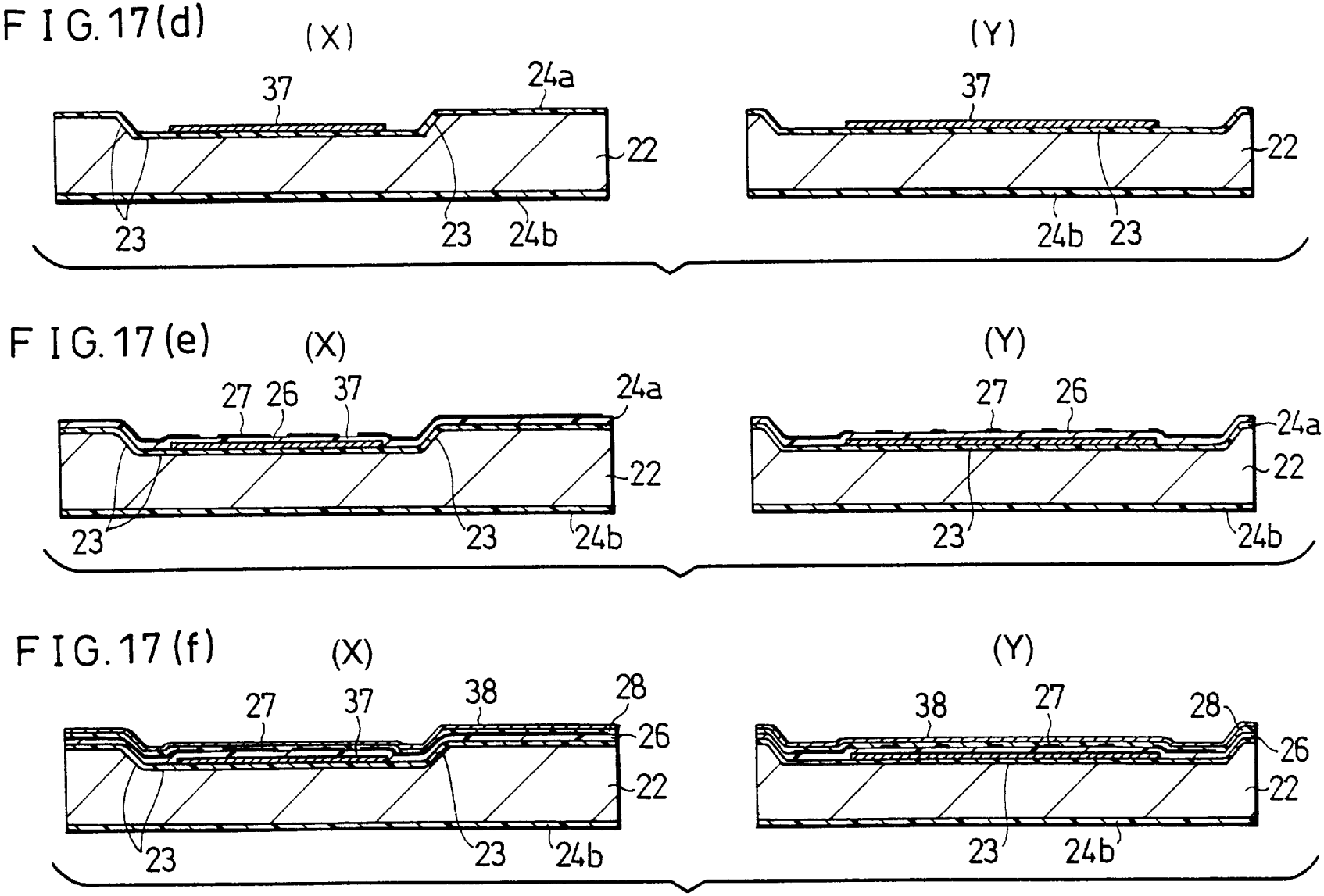
FIGS. 17(*d*) through 17(*f*) are cross-sectional views showing a manufacturing process of the thermal head.

Thereafter, as shown in FIG. 17(*d*), a first provisional layer 37 of, for example, 0.5 μm thick aluminum is formed on the surface insulating layer 24*a* disposed on the front side of the substrate 22 with, for example, sputtering method. Then the first provisional layer 37 is processed to form a pattern corresponding to the gap 30 shown in FIGS. 12 and 13 on the bottom surface of the concave portion 23 of the substrate 22 with photolithography technique and etching method. As a result, the thickness of the gap 30 is determined by the thickness of the first provisional layer 37.

Next, as shown in FIG. 17(*e*), the first insulating layer 26 of, for example, 0.5 μm thick silicon oxide is formed on the first provisional layer 37 and the surface insulating layer 24*a* with, for example, sputtering method. Then, for example, a 0.01 μm tantalum film and a 0.1 μm thick nickel film which will become the heater layer 27 are formed on the first insulating layer 26 with, for example, sputtering method. Thereafter, the heater layer 27 is formed in a wobbling pattern on the first insulating layer 26 by patterning the tantalum and nickel films with photolithography technique and etching method. The tantalum film is provided to improve adhesion between the first insulating layer 26 and the nickel film.

Next, as shown in FIG. 17(*f*), the second insulating layer 28 of, for example, 0.5 82 m thick silicon oxide is formed on the heater layer 27 with, for example, sputtering method. Then, for example, a 0.01 μm thick tantalum film (not shown) and a 0.1 μm thick nickel film 38 are formed as a part of the buckling body 29 (will be described later) on the second insulating layer 28 with, for example, sputtering method. The tantalum film is provided to improve adhesion between the second insulating layer 28 and the nickel film 38.

Figures 18G, 18H, 18I:
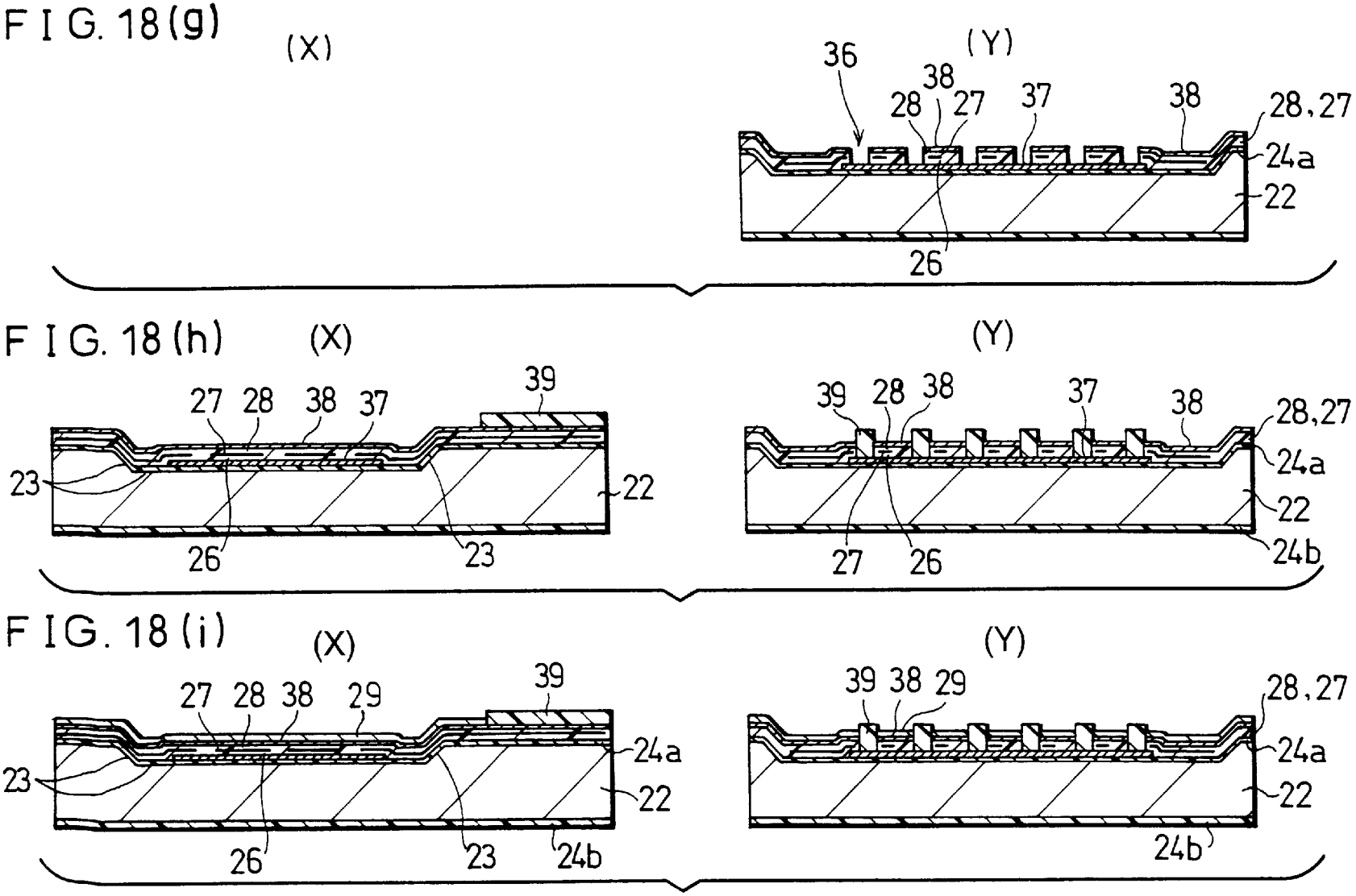
FIGS. 18(*g*) through 18(*i*) are cross-sectional views showing a manufacturing process of the thermal head.

Thereafter, as shown in FIG. 18(*g*), the slits 36 are formed through the nickel film 38, the first insulating layer 26 and the second insulating layer 28 with photolithography technology and etching method.

Next, as shown in FIG. 18(*h*), photoresist 39 is applied on the nickel film 38. The photoresist 39 is processed to be in a shape corresponding to a pattern of the slits 36 with photolithography technique.

In other words, the slits 36 formed through the nickel film 38, the first insulating layer 26 and the second insulating layer 28 are filled with the photoresist 39. The photoresist 39 is then treated with patterning so as to stick upwards above the surface of the second insulating layer 28 by a predetermined height with the same pattern width as the slits 36. The predetermined height should be greater than the thickness of a nickel plated film (will be described later).

Next, as shown in FIG. 18(*i*), to complete manufacture of the buckling body 29, the nickel plated film of a predetermined thickness (for example, 5 μm) is formed as the last portion of the buckling body 29 with, for example, electrolytic metal plating method. An example of electrolytic metal plating is nickel plating method with, for example, nickel bath of nickel sulfamate, using, for example, the nickel film 38 as an electrode.

Figures 19J, 19K, 19L:
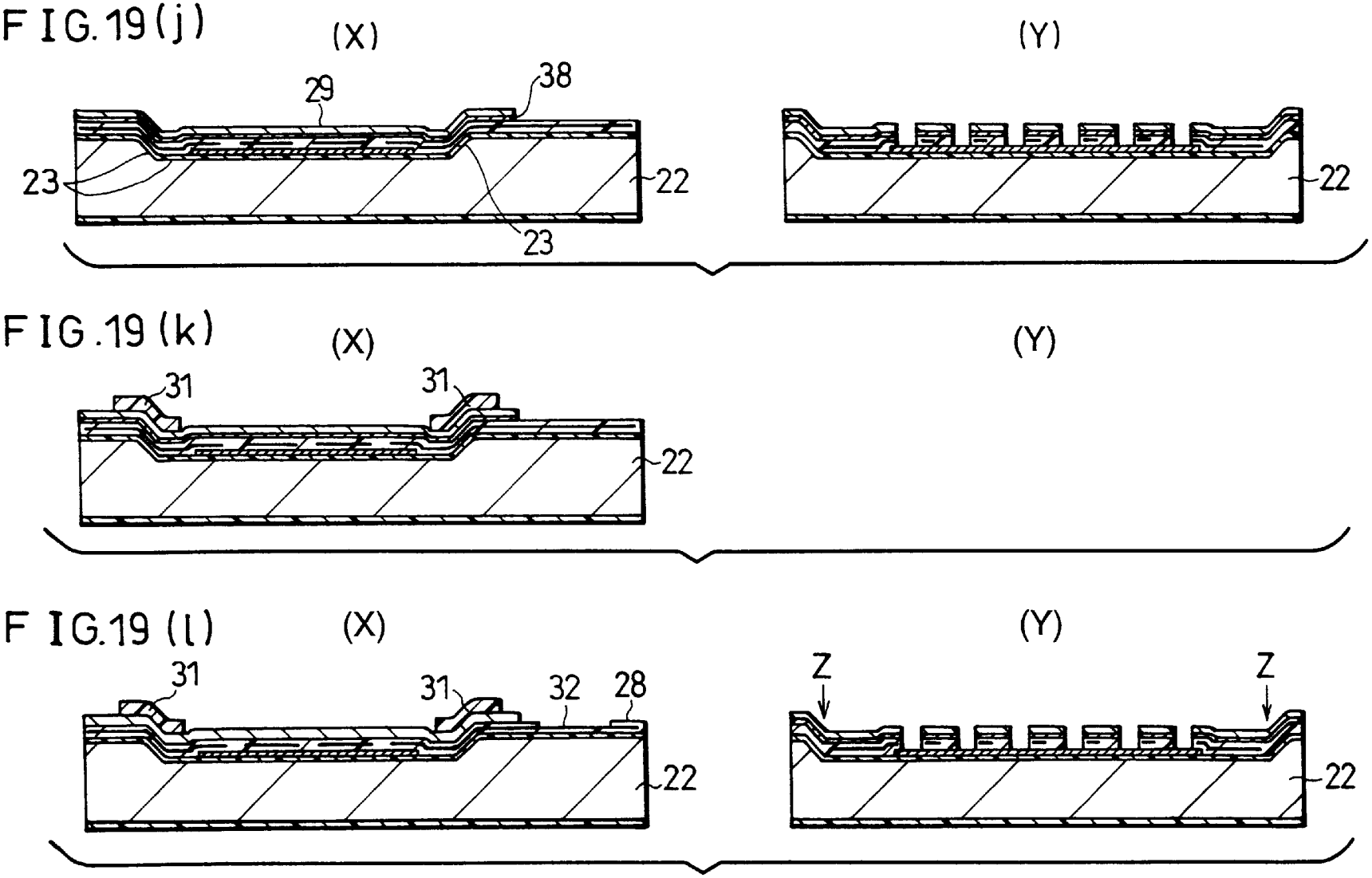
FIGS. 19(*j*) through 19(*l*) are cross-sectional views showing a manufacturing process of the thermal head.

Thereafter, as shown in FIG. 19(*j*), the photoresist 39 is removed, the nickel film 38 and the tantalum film formed thereunder receive patterning with ion milling etching method.

Next, as shown in FIG. 19(*k*), for example, a 1.5 μm thick silicon nitride film is formed with, for example, sputtering method and then treated with patterning. The guides 31 shown in FIG. 12 are formed in this manner.

Next, as shown in FIG. 19(*l*), the operation electrode 32 for external connection is provided to the second insulating layer 28 with photolithography technique and etching method.

Figures 20M, 20N:
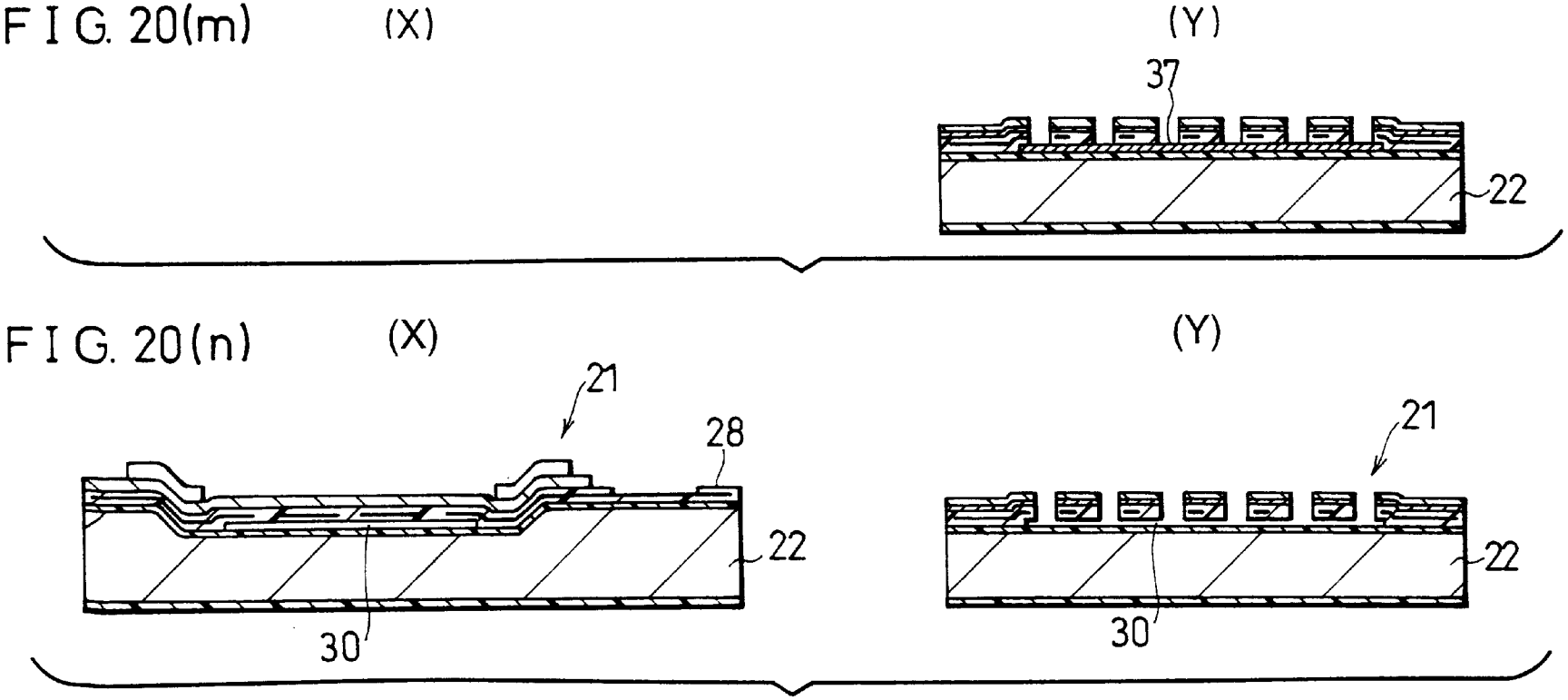
FIGS. 20(*m*) and 20(*n*) are cross-sectional views showing a manufacturing process of the thermal head.
Figure 21:
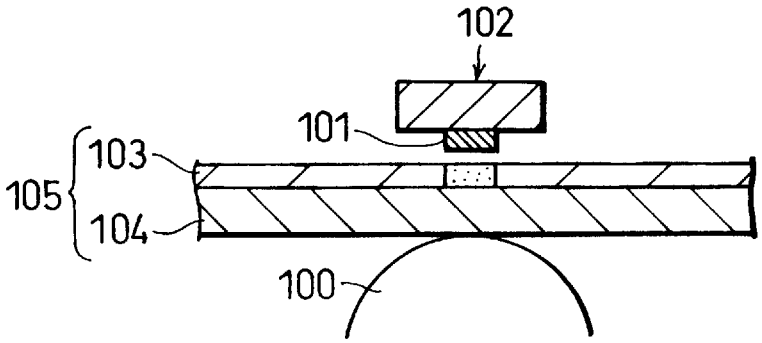
FIG. 21 is a cross-sectional view showing a state where a conventional thermal head is carrying out recording with thermosensitive recording method.
Figure 22:
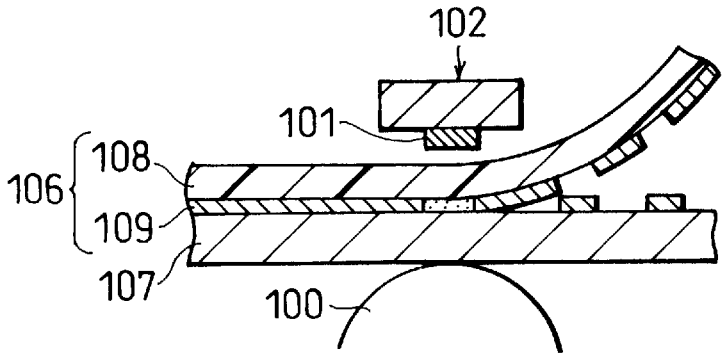
FIG. 22 is a cross-sectional view showing a state where the thermal head is carrying out recording with melting type thermal transfer recording method
Figure 23:
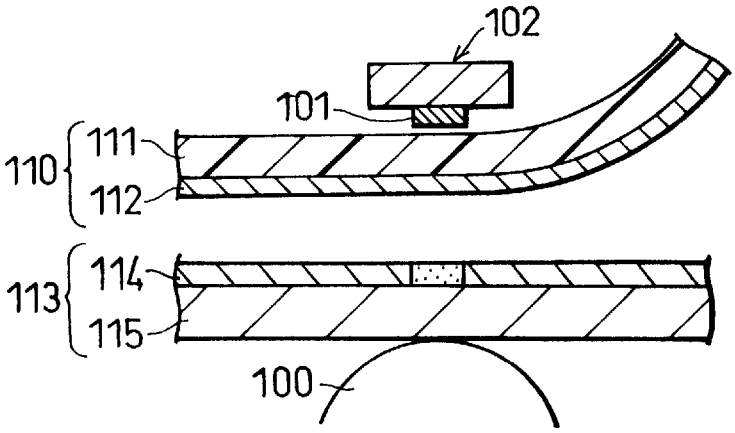
FIG. 23 is a cross-sectional view showing a state where the thermal head is carrying out recording with sublimation type thermal transfer recording method.
Figure 24:
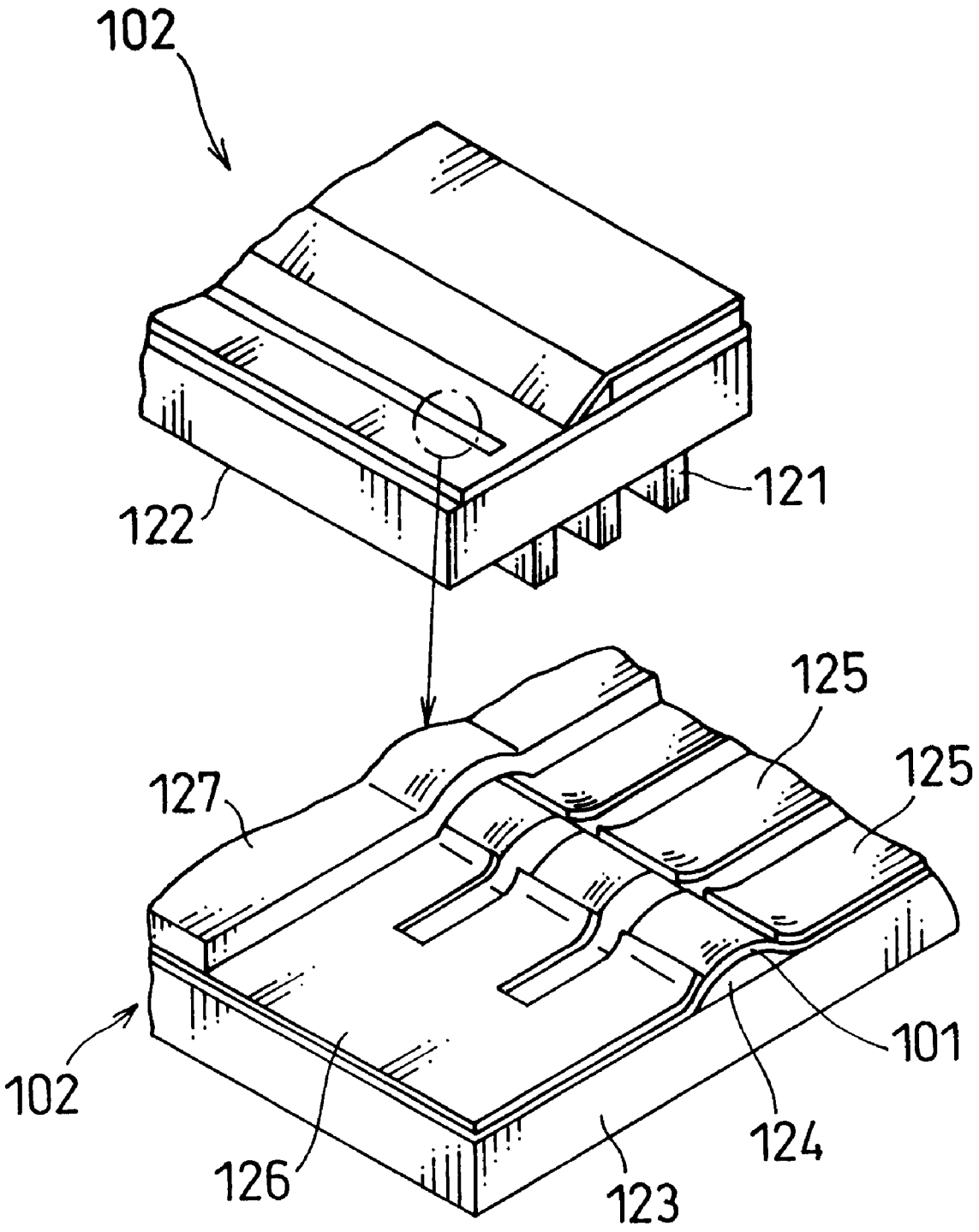
FIG. 24 is a simplified perspective view showing a configuration of the thermal head.

Then, dicing is carried out at a pair of opposite end portions of the substrate 22 (that is, the portions denoted by the arrows Z) so as to form a chip shown in FIG. 20(*m*).

Finally, as shown in FIG. 20(*n*), the substrate 22 in this state is dipped in a potassium hydroxide solution, and the first provisional layer 37 is removed with etching method to form the gap 30. The thermal head 21 is completed in this manner.

With the configuration, since the buckling exothermic bodies 25 are made with semiconductor integration process, the buckling exothermic bodies 25 are manufactured with high precision and the head resolution can be improved. Moreover, since the concave portion 23, the guides 31 and the gap 30 can be formed continuously in one process, the manufacturing processes are simplified. Furthermore, since the concave portion 23, the guides 31 and the gap 30 are easily specified in thicknesses, relative positions of the thermosensible paper 7 and the buckling exothermic body 25 are easily specified.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A thermal head which contacts a thermosensible body for developing color in response to heat and thereby forming an image on the thermosensible body, said thermal head, comprising:

a substrate; and exothermic resistors fixed at a pair of opposite end portions thereof onto said substrate, wherein each of said exothermic resistors thermally expands from a non-shifted state in which there is virtually no thermal stress, and buckles and distorts so as to contact the thermosensible body when an inner temperature of each of said exothermic resistors reaches a predetermined temperature or higher.

2. The thermal head as defined in claim 1, further comprising energizing means for selectively energizing at least one of said exothermic resistors, wherein said at least one of said exothermic resistors is composed of a conductive material, fixed at the opposite end portions thereof onto said substrate via insulating members, and heats with resistance thereof when energized by said energizing means.

3. The thermal head as defined in claim 1, wherein at least one of said exothermic resistors is provided approximately at the center thereof with a protrusion sticking out in the same direction as said at least one of said exothermic resistors buckles and deforms.

4. The thermal head as defined in claim 1, wherein said substrate is provided with a guide for supporting the thermosensible body, the guide being disposed on said substrate outside each of the opposite end portions of at least one of said exothermic resistors and sticking out in the same direction as said at least one of said exothermic resistors buckles and deforms.

5. The thermal head as defined in claim 4, wherein the guide has a top portion approximately as high as a top portion of said exothermic resistor when said at least one of said exothermic resistors buckles and deforms.

6. The thermal head as defined in claim 1, wherein said substrate has a concave portion, and wherein at least one of said exothermic resistors is disposed on a bottom of the concave portion.

7. The thermal head as defined in claim 6, wherein the substrate has a surface approximately as high as a top portion of said at least one of said exothermic resistors when said at least one of said exothermic resistors buckles and deforms.

8. The thermal head as defined in claim 6, wherein an upper surface of said substrate, other than the concave portion, serves as a guide for supporting the thermosensible medium.

9. The thermal head as defined in claim 1, wherein the predetermined temperature is a color developing temperature of the thermosensible medium.

10. The thermal head as defined in claim 1, wherein each of said exothermic resistors is composed of at least a first insulating layer, a heater layer, a second insulating layer and a buckling body laminated in this order, and when the buckling body is heated by the heater layer to a predetermined temperature or higher, the buckling body thermally expands from a non-shifted state in which there is virtually no thermal stress, and buckles and distorts.

11. A thermal head, comprising:

a substrate having a concave portion of a predetermined depth; and at least one exothermic resistor disposed on a bottom of the concave portion, wherein said at least one exothermic resistor is composed of at least a first insulating layer, a heater layer, a second insulating layer and a buckling body laminated in this order, and when the buckling body is heated by the heater layer up to a predetermined temperature or higher, the buckling body thermally expands from a non-shifted state in which there is virtually no thermal stress, and buckles and distorts.

12. The thermal head as defined in claim 11, wherein said at least one exothermic resistor is provided with a guide disposed on a pair of opposite end portions of said at least one exothermic resistor, said guide sticking out in the same direction as said at least one exothermic resistor buckles and deforms.

13. The thermal head as defined in claim 12, wherein the guide has a top portion approximately as high as a top portion of said at least one exothermic resistor when said at least one exothermic resistor buckles and deforms.

14. The thermal head as defined in claim 11, wherein said at least one exothermic resistor buckles and deforms so as to come into contact with a thermosensible medium that develops color when the buckling body is heated to a predetermined temperature or higher.

15. A method of manufacturing a thermal head, comprising the steps of:

(a) forming a concave portion of a predetermined depth with etching of a substrate;

(b) forming a first insulating layer on a bottom of the concave portion;

(c) forming a heater layer on the first insulating layer;

(d) forming a second insulating layer on the heater layer; and (e) forming a buckling body on the second insulating layer.

* * * * *